US006896429B2

(12) United States Patent
White et al.

(10) Patent No.: US 6,896,429 B2
(45) **Date of Patent: *May 24, 2005**

(54) CONSTANT DENSITY PRINTER SYSTEM

(75) Inventors: Dennis R. White, Fountain Valley, CA (US); Jeng-Dung Jou, Irvine, CA (US); Gordon B. Barrus, San Juan Capistrano, CA (US); Y. Grant Chang, Irvine, CA (US); John W. Gemmell, Aliso Viejo, CA (US); John S. Kinley, Costa Mesa, CA (US); Lihu Chiu, Arcadia, CA (US); Kevin P. Moore, Irvine, CA (US)

(73) Assignee: Printronix, Inc., Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/742,320

(22) Filed: Dec. 18, 2003

(65) Prior Publication Data

US 2004/0179881 A1 Sep. 16, 2004

Related U.S. Application Data

(63) Continuation-in-part of application No. 10/387,917, filed on Mar. 12, 2003, now Pat. No. 6,695,495.

(51) Int. Cl.[7] ..... B41J 2/315; B41J 27/12

(52) U.S. Cl. ..... 400/124.01; 400/197

(58) Field of Search ..... 400/124.01, 124.02, 400/249, 197, 236.2, 223; 101/183, 202, 425

(56) References Cited

U.S. PATENT DOCUMENTS

| | | | | |
|---|---|---|---|---|
| 4,091,914 A | | 5/1978 | Stipanuk | 400/196.1 |
| 4,536,098 A | | 8/1985 | Sheehan et al. | 400/196.1 |
| 4,653,947 A | | 3/1987 | Echols | 400/202.4 |
| 4,984,913 A | | 1/1991 | Silverman et al. | 400/249 |
| 5,092,695 A | | 3/1992 | Silverman et al. | 400/249 |
| 5,466,073 A | | 11/1995 | Rossi et al. | 400/197 |
| 5,511,888 A | | 4/1996 | Beach | 400/197 |
| 5,570,963 A | | 11/1996 | Gill | 400/197 |
| 5,595,223 A | * | 1/1997 | Hayao | 141/375 |
| 5,670,438 A | | 9/1997 | Badley | 502/120 |
| 5,685,653 A | | 11/1997 | Bringhurst | 400/197 |

(Continued)

FOREIGN PATENT DOCUMENTS

| | | |
|---|---|---|
| EP | 0707970 | 4/1996 |
| EP | 0723868 | 7/1996 |
| EP | 0987118 | 3/2000 |
| WO | WO96/09172 | 3/1996 |
| WO | WO97/15451 | 5/1997 |
| WO | WO00/40420 | 7/2000 |

*Primary Examiner*—Andrew H. Hirshfeld
*Assistant Examiner*—Wasseem H. Hamdan
(74) *Attorney, Agent, or Firm*—MacPherson Kwok Chen & Heid LLP; Tom Chen

(57) ABSTRACT

An ink density closed loop control system for an ink ribbon of an impact printer having a reservoir roller formed of an ink absorbent material with at least one or more channels within the reservoir roller fluidly connected to a pump and ink supply. A transfer roller can contact the reservoir roller for imparting ink to the ink ribbon. A sensor senses the relative amount of ink on the print ribbon and an electrical drive responsive to the sensor drives the pump for a flow of ink to the one or more channels. The sensor can sense ink on different segments of the ribbon and, with two or more channels in the reservoir roller can distribute ink to two or more segments of the reservoir roller depending upon the ink sensed at a particular segment of the ribbon. A further enhancement of this invention provides a multi-viscosity ink to compensate for changes in ambient temperature conditions.

32 Claims, 20 Drawing Sheets

U.S. PATENT DOCUMENTS

| | | | | | |
|---|---|---|---|---|---|
| 5,711,622 | A | | 1/1998 | Bringhurst et al. | 400/124.29 |
| 5,784,086 | A | * | 7/1998 | Hayao | 347/85 |
| 5,902,057 | A | | 5/1999 | Furrow et al. | 400/196.1 |
| 6,017,158 | A | | 1/2000 | Conlan | 400/197 |
| 6,089,768 | A | | 7/2000 | Barrus et al. | 400/238 |
| 6,361,228 | B1 | | 3/2002 | Barrus et al. | 400/223 |
| 6,478,486 | B1 | | 11/2002 | Ando | 400/236.2 |
| 6,478,487 | B1 | | 11/2002 | Jou et al. | 400/240 |
| 2001/0003955 | A1 | | 6/2001 | Mayer et al. | 101/183 |
| 2001/0006027 | A1 | | 7/2001 | Pfeiffer et al. | 101/425 |
| 2001/0010191 | A1 | | 8/2001 | Steinbacher | 101/202 |
| 2001/0011511 | A1 | | 8/2001 | Kawabata et al. | 101/350.1 |

* cited by examiner

FIG. 11
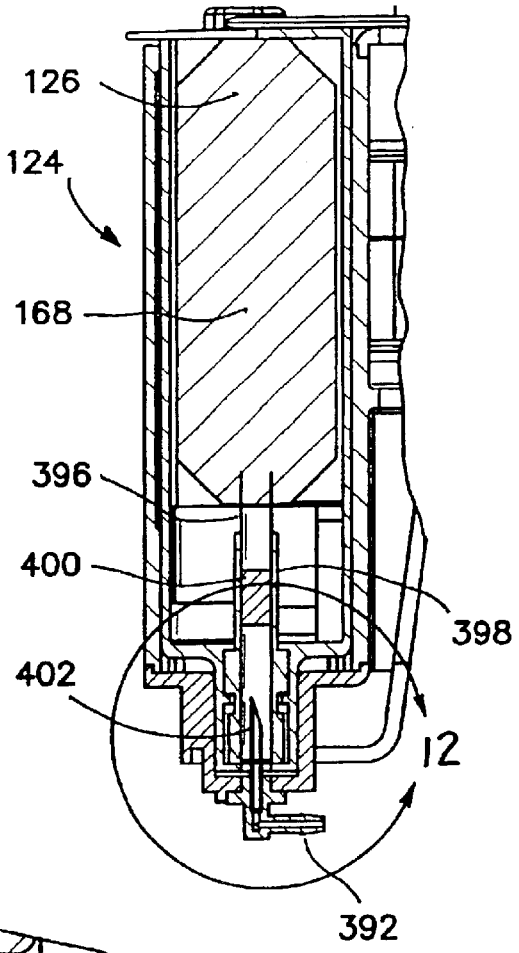
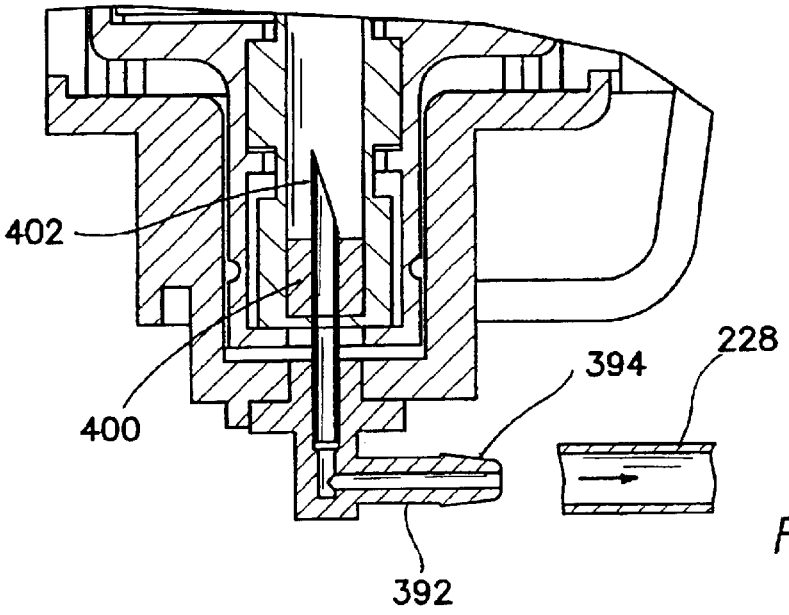
FIG. 12

CONSTANT DENSITY PRINTER SYSTEM

REFERENCE TO RELATED APPLICATIONS

This is a continuation-in-part application of U.S. patent application Ser. No. 10/387,917, entitled "Constant Density Printer System", filed Mar. 12, 2003, now U.S. Pat. No. 6,695,495, patented on Feb. 24, 2004.

BACKGROUND

1. Field of the Invention

This invention relates to impact printers, and more specifically, to maintaining the ink content on the print ribbon of such printers.

2. Related Art

The prior art of impact printing in line matrix printers is accomplished when hammers are released from retention. This causes their hammer tips to strike against an inked ribbon as it traverses between the hammers and the print media. The print media is backed-up on the other side by a hard platen, so that the impact from the hammer tip leaves ink dots on the print media. The print media can be paper, labels, multi-layer forms, including plastic and combinations of plastic and paper.

The inked print ribbon traverses at an angle between a single or dual row of hammers and the media. Each hammer strikes against the print ribbon in a dedicated zone running the length of the ribbon. The ribbon width and angle of inclination are such that the edges of the inked print ribbon are generally not struck by the hammers. This provides a boundary of tolerance to accommodate dimensional variations.

In certain line matrix printers, the ribbon reciprocates between two spools. The ribbon reverses direction when either of the spools becomes empty of ribbon. In others, the ribbon is continuous and circulates in a loop from a cartridge across the print hammers.

In dual-row hammer line matrix printers as opposed to single row hammer line matrix printers, the arrangement is slightly more complicated. In such cases the two rows of hammers simultaneously print adjacent rows of print. This effectively doubles the throughput of the printer.

To accommodate the two rows of hammers, an inked print ribbon traverses at a slightly shallower incline across the hammers than in a single-row printer. The result is that the middle area of the ribbon is struck twice during each pass of the ribbon, while the outer boundaries are only struck once. This has adverse print quality effects. The defects in print quality when ink is depleted from a ribbon whether it be a dual-row hammerbank or a single-row hammerbank can become quite apparent.

When the ink supply in the ribbon gradually decreases, it causes undesirable effects. Firstly, the density, or darkness of the printed dots decreases continuously as ink is consumed. Thus a page printed near the end of the ribbon life is much lighter than a page printed from a fresh ribbon.

Secondly, pre-inked ribbon becomes damaged as ink is consumed. This is because the ink, which lubricates the ribbon fibers, is depleted. Damaged ribbon can result in print failure at the edges of the media, as well as certain kinds of mechanical failure such as paper jams and hammer print tip clogging.

When hammer strikes are toward the center of the ribbon the unused borders of the ribbon retain a disproportionately large quantity of ink. This larger quantity of ink slowly diffuses toward the center of the ribbon. This produces darker dots on the edges of the printed page than are produced elsewhere. This effect in the art is referred to as the diffusion effect.

The fact that the middle portion of the ribbon in dual-row printers is struck twice, means that the ink is depleted more rapidly from that portion than from the edges. After a relatively small amount of printing, a light and dark pattern appears in adjacent lines of print. One of the two printed lines, for instance that which is printed by the upper row of hammers, will be darker on the right side than on the left. The next line printed by the lower row of hammers will be darker on the left and lighter on the right. In the art this is referred to as banding.

Uneven printing demands in various forms and orientations present substantial depletion of ink on a ribbon in uneven patterns. For example by printing only on the left side of the media, or by printing heavy graphics in one specific area of a page, repeatedly for many pages, can cause the print density to vary across the width of subsequent pages. This defect in the printing art is referred to as the column effect.

Another consideration is the inherent flexibility of impact printers. Such printers handle a wide range of print media. This results in a concomitant range of ink absorption rates. Consequently, ink depletion varies with print media, and location of printing on the media.

To overcome the foregoing problems, the art has developed re-inking devices. However, these re-inking devices typically only apply ink uniformly over the entire ink ribbon, while other re-inking devices generally re-apply ink to the ribbon without sensing areas in need of ink. These types of re-inking devices may not produce uniform printing when specific portions of the ribbon are used heavily or lightly in relation to the other portions of the ink ribbon.

Accordingly, it is desirable to apply ink to ribbons of impact printers that overcomes the deficiencies discussed above.

SUMMARY

According to one aspect, the invention hereof employs a closed-loop system of ink replacement. Information about ink depletion and printing demand is used to control one or more pumps to feed the proper amount of ink back into the ribbon in areas where ink is being most rapidly depleted. The type of ink used with the present invention can be a multi-viscosity ink or a high viscosity ink. A multi-viscosity ink is made of two or more inks, each ink having a different viscosity at the same temperature. A high viscosity ink, as used herein, refers to inks having a viscosity of 1000 cps or higher at temperatures around 25° C. or higher. Another aspect of the invention incorporates a thick ink ribbon with the closed-loop system. As used herein, "thick" refers to ribbons having at least a thickness of 0.0045". According to another aspect of the invention, an ink-out detection system is used with the closed-loop system of ink replacement. The ink-out detection system monitors the current of a solenoid or other electromechanical device driving the ink pumps. A change in the current profile over a period of time, caused by a change in the solenoid or other device, indicates that the ink is depleted. This system requires no other hardware or devices to measure the ink out condition. At the point of detection, the ink bag or container is completely empty allowing for 100% of the ink to be used. Systems that estimate the ink usage may leave ink remaining in the cartridge unused.

One aspect of the invention is specifically oriented to diminish the variations due to ink consumption. It helps to maintain consistency of printing or constant density of the print toward, or near the end of the ribbon life to eliminate lighter printing that is normally encountered.

Another benefit of this invention is that ribbon damage is reduced by maintaining ink in the ribbon to lubricate the ribbon's fibers. This helps to avoid print failure on the edges of the media as well as mechanical failure.

A further improvement of this invention is that the quantity of ink through the ribbon is proportionalized to eliminate disproportionality of the ink between the edges that are not impacted and the central regions. The net result is to diminish the darker dots near the edges of a printed page. This helps to eliminate the diffusion effect.

Another aspect of the invention is to diminish the characteristics of printed material that is darker due to double strikes in certain portions of the ribbon. A concomitant of this is to lessen the differentiation between an upper row of hammers and a lower row of hammers with respect to each of the lines printed by the hammers. Thus, banding, as is known in the art, is diminished.

A further aspect is to unify the printing effect on various types of media. To this extent, the invention also serves to improve printing that takes place in concentrated areas, such as in heavy graphics and bar code orientations. This invention serves to diminish the depletion of the ink based upon such types of printing to avoid the column effect of the prior art.

The invention also provides the ability of an impact or line printer to handle various types of media that have various absorption rates.

Another consideration is that of ambient temperature conditions. This invention can compensate for changes in ambient temperature conditions by providing a multi-viscosity printer ink that can accommodate itself to a broader range of ambient temperature conditions than a single viscosity printer ink.

Furthermore, the use of a multi-viscosity ink provides additional improvements to print quality. The lower viscosity inks in the ink mixture helps lower the "apparent viscosity" at lower operating temperatures, while the higher viscosity inks help maintain sufficient viscosity for printing applications at the higher end of operating temperatures. The net effect is that the "apparent viscosity" remains more nearly constant across the printer's operating temperature range than with single or mono-viscosity inks. Using multi-viscosity ink mixtures helps reduce or eliminate the propensity for ink smearing on the print media and ink migration into the printing mechanism at high temperatures. Print density and ink distribution in the ink ribbon at lower temperatures is also maintained.

In another embodiment, a high viscosity ink is used with the closed-loop ink dispensing system, which can extend the life of the ribbon, since high viscosity inks act as a lubricant on the ribbon fibers, reducing frictional forces that develop within the ribbon and abrasion against guiding surfaces in the ribbon path.

The closed-loop system of dispensing ink dispenses ink on a thick ribbon, providing the advantage of increased ribbon life. This is due in part to less impact forces from the hammer to the underlying print media.

In summation, this invention comprises a constant density printer which maintains through the content of the ink in the ribbon, the quality of the ribbon, and a relatively proportional amount of ink in proximate location to the duty areas which are being impacted by the print hammers by way of a sensor that determines the amount of ink on the ribbon and a supply roller that is served by variable pumps to feed ink to a respective portion of the ribbon in a closed control loop, in which multi- or high viscosity inks can be used, with or without a thick ink ribbon. The constant density printer may also incorporate an ink-out detection system.

More specifically, the invention provides for ink being pumped from a liquid ink supply into a spool or inking roller that forms a reservoir roller having a manifold. The reservoir roller supplies ink to a transfer roller which in turn deposits the ink onto the ribbon. The reservoir roller has multiple segments that can supply ink to various segments of the print ribbon. The various segments of the print ribbon have various rates of ink depletion which can be accounted for and sensed. The ink in a segment of the ribbon is replaced by the reservoir roller having a segment dedicated to a particular segment of the ribbon and replacing the ink in that segment.

According to one embodiment, ink depletion is detected using an ink-out detection system. The ink-out detection system monitors the solenoid current of the pumps pumping ink from the ink supplies or cartridges to the ink ribbon. The current changes when ink is depleted from the cartridges. Monitoring a change in the electrical current profile over time senses a change in the mechanical load caused by the ink-out condition. Thus, when the sub-system detects a change over a period of time in the solenoid current, an "ink-out" is detected and indicated, allowing the user to replace or re-fill the empty ink cartridge. In one embodiment, a linear solenoid is used as the pump driving mechanism. However, other electromechanical devices used to actuate the ink pump (e.g. rotary motor) may be suitable in other embodiments. This type of system requires no additional mechanism to measure the ink out condition other than the electrical current measurement during the pump actuation. When detected, the bag is replete of ink, allowing 100% of the ink to be used.

The ribbon inking takes place by means of appropriate amounts of ink being fed to the reservoir roller through the spool or manifold. This is controlled by a sensor which senses the amount of ink on the ribbon in multiple segments. The sensor then signals a pump to provide for a certain amount of ink to the roller in a series of applications at particular segments corresponding to segments of the ribbon.

In one embodiment, after the ribbon has been completely wound on a take-up spool, it reverses direction. As the ribbon reverses direction, it passes through the inking station after being impacted and is then wound onto the original supply spool. Thus, each segment of the ribbon encounters two printing cycles, which are alternated by two re-inking cycles as the ribbon translates from one spool to the other. At the same time, the amount of ink on the ribbon is sensed by the sensor, which controls the pumps to provide for an appropriate amount of ink on the ribbon at its various segments.

In another embodiment, the ribbon is continuous and passes from a cartridge across the print hammers. As the ribbon passes through the cartridge, it also passes through the inking station on a continuous basis for the appropriate supply of ink.

To further enhance this invention, the strikes of the hammers on the print ribbon in a particular location are accounted for. Thus, the duty cycle or impact cycle on a particular portion or segment of the ribbon is recorded and inking is provided in the heavily struck regions to replace any depleted ink.

A sensing of the ambient temperature conditions permits a calibration of the sensor.

A further improvement is the use of a multi-viscosity ink to compensate for changes in ambient temperature conditions.

Thus, the re-inking devices maintain the inked ribbon in an improved usable condition by keeping the ribbon's ink quantity and distribution constant. The ink is replaced proportionally to the depletion rate and proximate to the location from which it is removed from the print ribbon, resulting in uniform printing even when certain portions of the ribbon are more heavily used than other portions.

The present invention will be more fully understood when taken in light of the following detailed description taken together with the accompanying drawings.

BRIEF DESCRIPTION OF THE DRAWINGS

FIG. 11 is a sectional view showing the ink supply cartridge of this invention.

FIG. 12 is a detailed sectional view of the portion contained within circle 12 of FIG. 11.

Use of the same or similar reference numbers in different figures indicates same or like elements.

DESCRIPTION OF THE PREFERRED EMBODIMENTS

Figure 1:
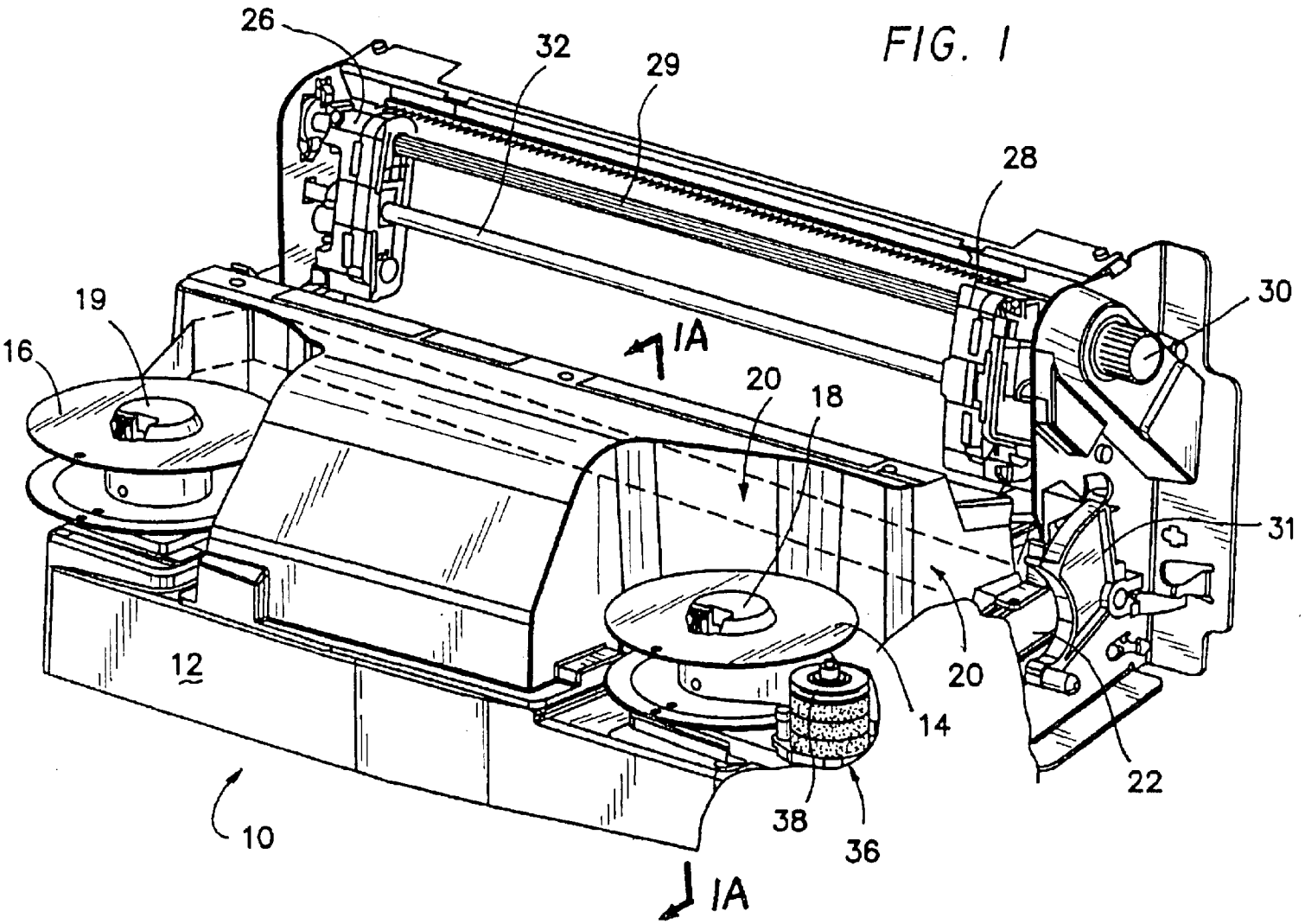
FIG. 1 shows a perspective view of a line printer having a series of hammers on a hammerbank incorporating one embodiment of the invention.

FIG. 1 shows a perspective view of this invention in the form of an impact line printer 10. The impact line printer 10 can be mounted on a stand, a base, or can be free standing in a cabinet. In this particular case, the line printer 10 has been shown in a configuration with respect to the operating elements and none of the appurtenant support material or devices.

The line printer 10 has a base 12 which mounts a pair of ink ribbon spools 14 and 16. The ribbon spools 14 and 16 are emplaced upon hubs or spindles 18 and 19. The hubs 18 and 19 have spring loaded catches which tend to secure the ribbon spools onto them for driving purposes.

The ribbon spools 14 and 16 provide for the traversal of a ribbon 20 which is shown in dotted configuration. The ribbon 20 traverses at a slight angle in order to accommodate the ribbon passing and being struck at various portions as it traverses over the hammerbank in the manner set forth hereinafter.

The ribbon 20 shown in the dotted configuration passing on the interior of the line printer 10 is served by a ribbon guide 22. The guide 22 has two electrical contacts which sense when the ribbon 20 is coming to an end. The contacts sense a conductor of the ribbon 20 which can be a wire, a conductive plastic portion, or other device such as a conductive plastic leader in order to determine when the ribbon 20 is coming to the end, as is known in the art.

As an alternative, the continuous ink ribbon cartridge of FIG. 17 can be utilized, which will be described in more detail below.

In order to drive the media such as paper, labels, or other media to be printed on, a pair of tractors 26 and 28 are utilized. The tractors 26 and 28 have toothed wheels which are known in the art in order to drive the media. The tractors 26 and 28 can be driven by a tractor drive and adjusted by means of a knob 30 for manually incrementing the media. A platen adjustment lever 31 is shown to open and close the platen in the throat of the line printer 10.

Supporting the respective tractors is a support rod 32 for providing support and adjustment of the tractors.

FIG. 1 shows a segmented portion broken away from the remaining portion. This will be detailed hereinafter showing not only the re-inking portions, but also the various systems for re-inking and providing constant density printing for the line printer 10. The re-inker has a porous reservoir roller 36 having three respective portions or segments to be detailed hereinafter. The roller 36 turns with the movement of the ribbon 20 and is provided with a manifold portion 38.

Figure 1A:
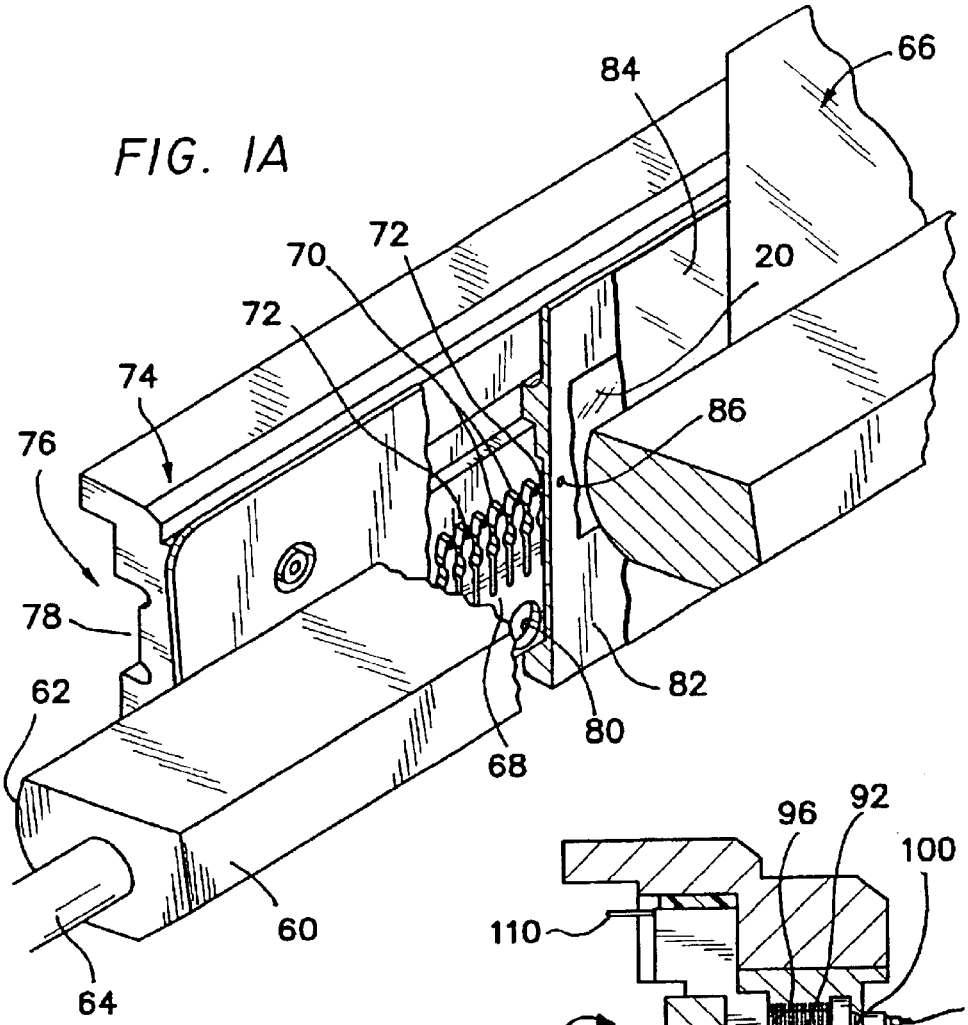
FIG. 1A shows a fragmented perspective view of the hammerbank of FIG. 1 along the directional line 1A—1A.
Figure 1C:
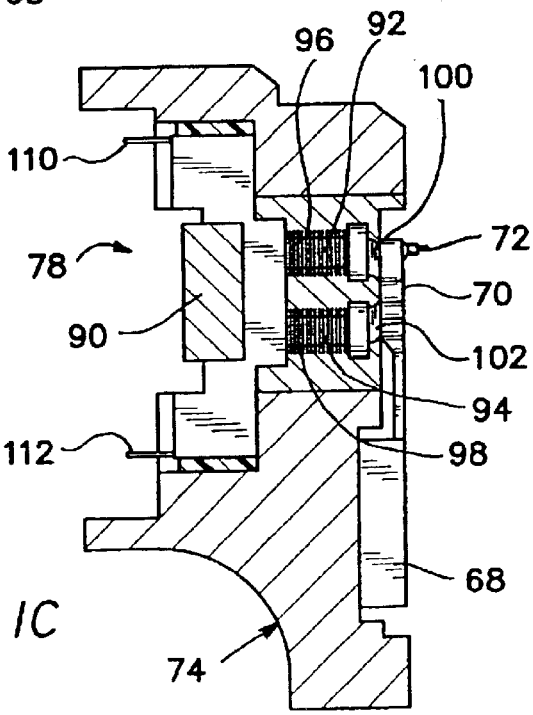
FIG. 1C shows a sectional view along the directional line 1C—1C of FIG. 1A.
Figure 1B:
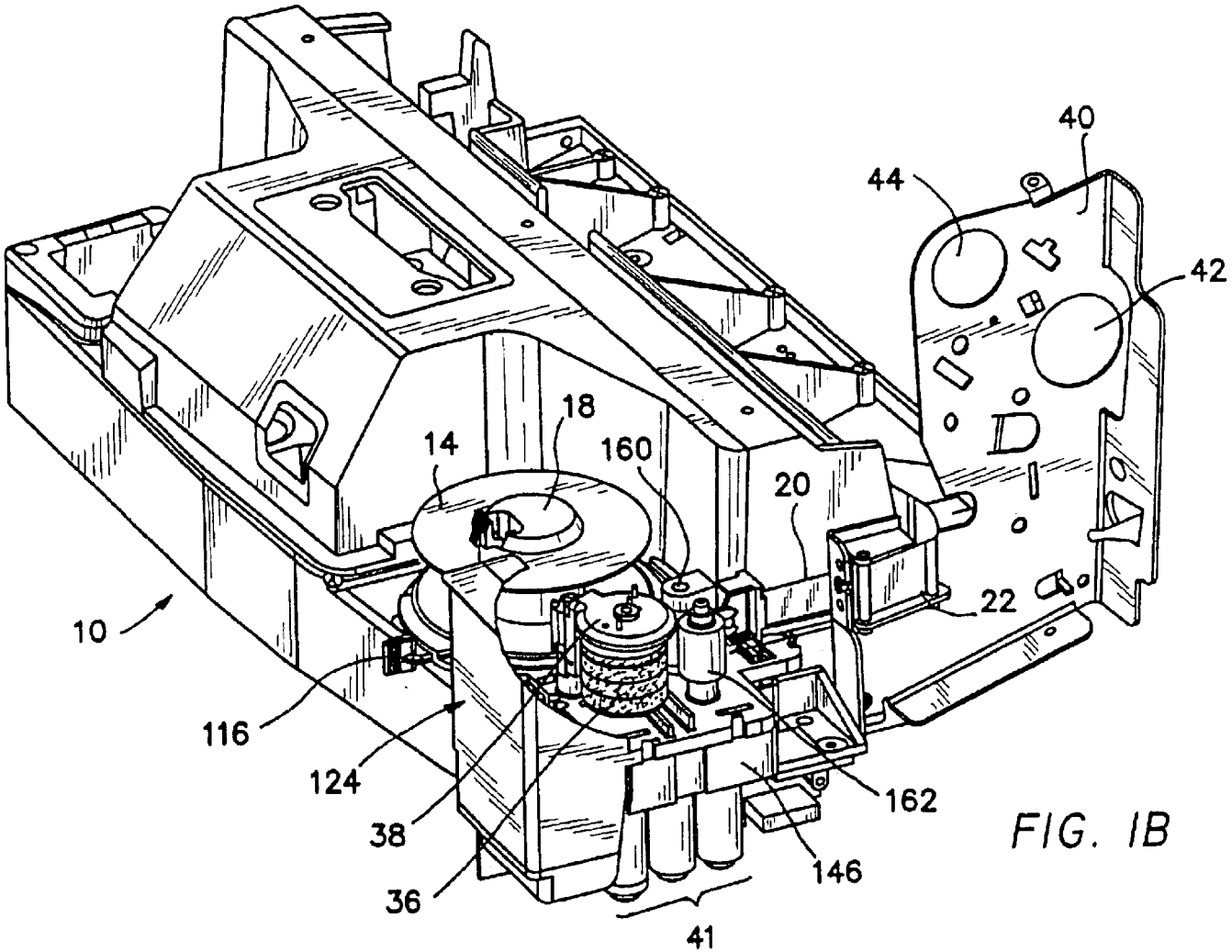
FIG. 1B shows a perspective view of one embodiment of the invention with merely the framework and the re-inker.

FIG. 1B shows that the line printer 10 framework with various elements. These include the ribbon spool 14 and its hub 18 that holds the print ribbon 20 shown being fed around the ribbon guide 22.

An end support frame 40 is shown into which the motor drive is affixed into opening 42. The shaft for the tractor in the form of shaft 29 between the respective tractors 26 and 28 passes through and is supported by opening 44.

The basic design, operation, and major components of the re-inker are such wherein ink is initially pumped from a liquid ink cartridge within an ink box, container, or other holding means 124. The cartridge holds the ink to be pumped from an internal reservoir by one or more mechanical pumps driven by solenoids 41. The solenoids 41 each drive ink through a respective pump from the cartridge to the manifold 38 allowing flow into the porous reservoir roller 36. A pressure roller 160 mounted on a spindle and gimbal mounting presses the ribbon 20 between it and a transfer roller 156 described hereinafter.

Finally, a de-inking roller 162 removes excess ink on the ribbon 20 as it passes out of the re-inking system. The de-inking roller can be substituted with a plurality of rollers depending upon the viscosity of the ink and the flow characteristics in order to remove excess amounts of ink.

Looking more particularly at FIG. 1A in order to review the print hammers of this invention, a fragmented perspective view has been taken in the directions of line 1A—1A of FIG. 1. In this particular view, a platen 60 has been shown with a platen face 62 that can be adjusted by a rotatable and moveable platen support 64. The platen is such where a plurality of hammers impact the print ribbon 20 to allow for printing on a media 66 which can be in the form of paper, fan fold forms, labels, plastic mounted on underlying carrier configurations or any other suitable media as shown generally by media 66.

A fret 68 of hammers is shown from which a plurality of hammers 70 are formed. The hammers 70 can be formed on the frets 68 by any machining process including laser and electro-milling.

Each of the hammers 70 has a printing tip 72 which impacts the print ribbon 20 to cause a dot to be printed on the media 66 through a dot matrix pattern.

The hammers 70 on the fret 68 are mounted on a hammerbank that comprises a series of the hammers 70. The hammerbank has a supporting base 74 that is cast or milled from an elongated bar. Internal of the hammerbank base 74 on the backside thereof is a space, groove, or channel 76 into which a printed circuit board can be mounted as well as permanent magnets to provide for the retention of the hammers 70. The printed circuit board in the space 76 is accommodated by means of a configuration 78 in the base of the channel 76 so that permanent magnets can also be mounted in an elongated manner. This can be seen more clearly in FIG. 1C as described hereinafter.

The hammers 70 with the frets 68 are mounted by screw means 80 that secure the frets 68 into the base 74 of the hammerbank. In order to provide a cover, rigidity, and support, a ribbed hammerbank cover 82 is provided. A mask 84 is utilized in order to mask the ink of the print ribbon 20 from smearing and smudging the media 66.

Within the hammerbank cover 82 and mask 84 are a series of openings 86 which allow the tips 72 of the hammers 70 to impact the print ribbon 20. The openings 86 are indexed in the mask 84 to provide for passage of the tips 72 through the mask and the hammerbank cover 82.

Looking more specifically at FIG. 1C, it can be seen wherein the hammerbank base 74 has been shown with the groove or channel 78. The groove or channel 78 is provided with one or more permanent magnets 90. The permanent magnet 90 is connected to pole pieces 92 and 94 having windings 96 and 98 therearound. The windings 96 and 98 are utilized to overcome the magnetism from the permanent magnets 90 that retain the hammers 70 against the pole pieces.

The pole pieces 92 and 94 terminate in pole piece ends 100 and 102. These pole piece ends 100 and 102 create a magnetic circuit with the permanent magnet 90 so that the retention of the hammers 70 can be maintained. The hammers 70 in order to have an appropriate striking effect have tips 72 welded, brazed or formed in any particular manner on the hammers 70.

Generally, the hammers are retained against the pole piece ends 100 and 102 until a current is applied to the coils 96 and 98. This overcomes the permanent magnetism through the pole pieces 92 and 94. This is provided through terminals 110 and 112 that are connected to a circuit board that fits within the channel 78.

As can be appreciated, the tips 72 when striking the ribbon 20 impact it in a very concentrated and forceful manner. As a consequence, a displacement of ink occurs as well as a forceful impact against the resilience and fibrous characteristics of the ribbon 20. This particular invention helps to maintain the fibrous nature of the ribbon 20 through proper inking. Printing takes place in a consistent, constant, and generally uniform manner. However, an added benefit is that the print ribbon 20 is lubricated by the ink for longer life.

Figure 2:
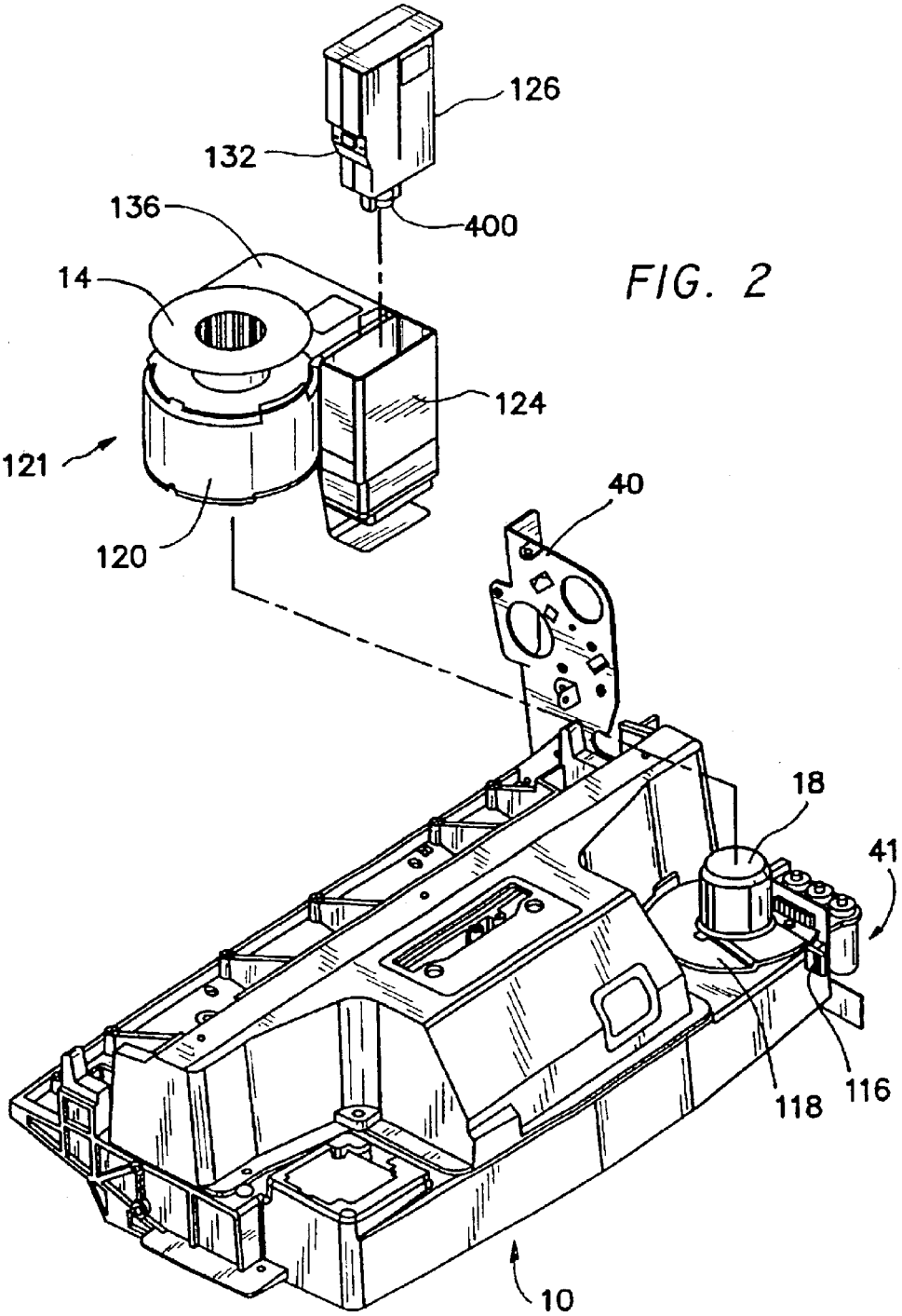
FIG. 2 shows a perspective view from the other direction of the framework with the re-inker and ink reservoir in an exploded relationship.

Looking more particularly at FIG. 2, it can be seen wherein the hub 18 has been shown on the framework of the printer 10. The hub 18 receives a printer ribbon module that is locked in place by a locking lever 116. The locking lever 116 serves to secure the print module and hold it in place on an underlying platform 118.

From the exploded view of FIG. 2, it can be seen that an inked spool 14 is encapsulated within an enclosure 121. The inked spool 14 has a take-up spool connected thereto and overlying the enclosure 121. Fundamentally, the inked spool and the take-up spool correspond to spools 14 and 16 as previously shown. These particular spools are emplaced and interconnected for threading through the throat of the printer 10. Thus, the net result is to end up with a configuration of the spools 14 and 16 in place as seen in FIG. 1.

The printer module has a cartridge or ink reservoir receptacle 124. The ink reservoir receptacle 124 receives an ink cartridge 126. The ink cartridge 126 has a rubber membrane or septum 400 that seals the ink within the ink cartridge. The membrane or septum 400 provides for multiple sealing effects in order to prevent the flow of ink until the ink cartridge 126 has been emplaced in the cartridge receptacle 124.

A printed circuit board with contacts 132 is connected to the ink cartridge 126. It rests in the cartridge receptacle 124 so as to permit contact and information as to the fact that the cartridge 126 is in place. The electrical interface between the contactor and printed circuit board 132 provides for an ink cartridge presence and operational controls to allow for proper re-inking.

The entire re-inking module 121 can fit on the platform 118 and have a series of pumps that are actuated by solenoids 41. The pumps are mounted in a housing 136 that overlies the solenoids 41. The pumps will be detailed hereinafter with respect to the overall aspects of the solenoids 41 and pump functions that provide ink to the reservoir roller 36 through the reservoir roller manifold 38 (shown in FIG. 1).

FIG. 2 shows a cover 120 for the inked printing spool 14 which is seated on the hub or spindle 18. When seated, the take-up spool 16 is placed by threading through the printer throat onto hub 18 so that the system can be actuated. In order to secure the entire module 121, it is only necessary to emplace it on the platform 118 and then lock it with the latch formed on lever 116. The lever can be spring loaded in either direction and allow for movement and locking either on a hand actuated basis or an over-center spring loaded latch configuration that has been released by manually impinging against the lever 116.

Figure 3:
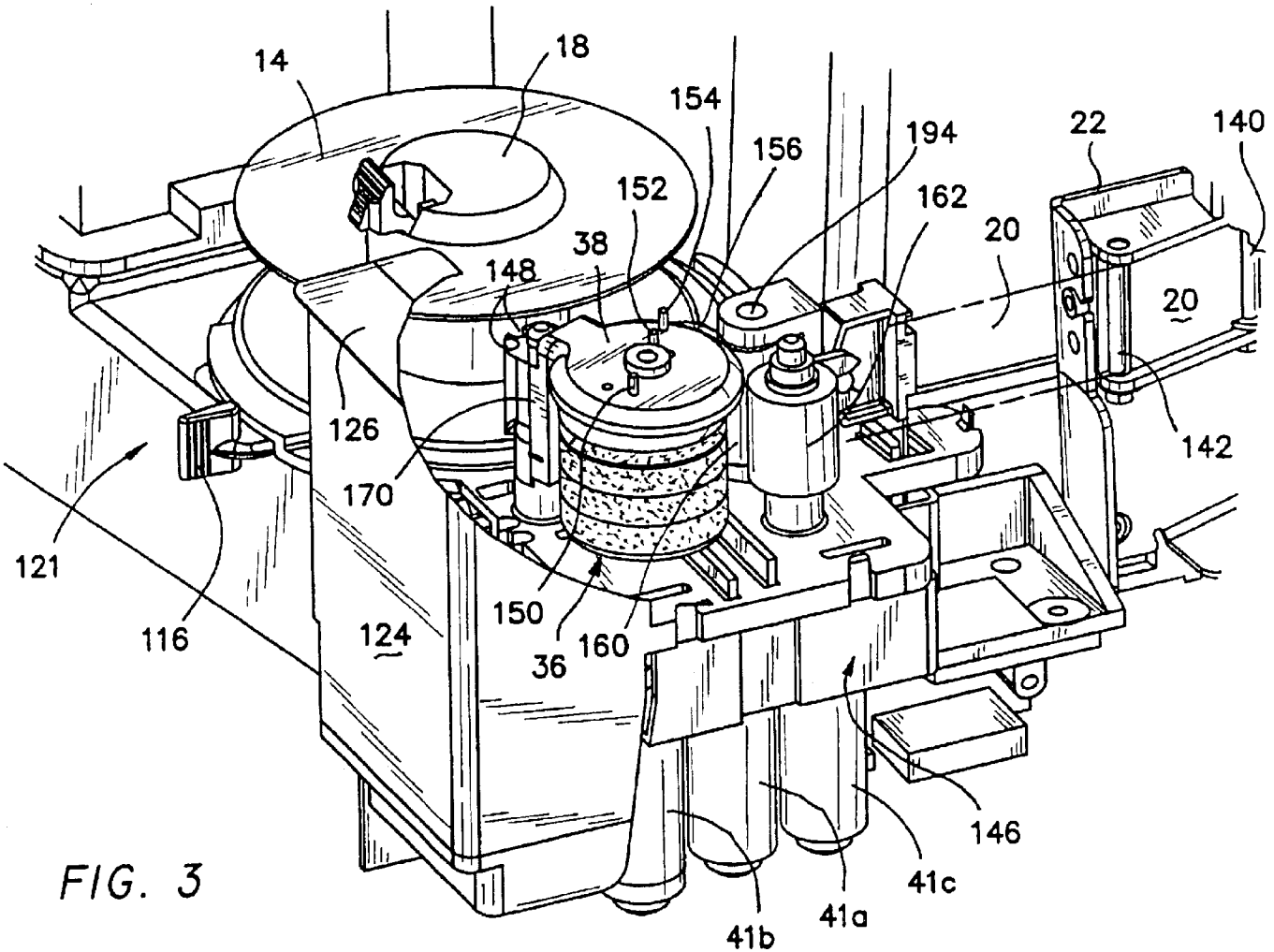
FIG. 3 shows the re-inker portion of the invention to provide constant density printing as taken from a detail of FIGS. 1B and 2.

FIG. 3 shows, more specifically, the ribbon guide 22. The ribbon guide 22 has a ribbon sensor comprising conductive bars 140 and 142. The conductive bars 140 and 142 allow for an electrical conductor in the ribbon 20 to bridge them. This creates a signal for determining when the end of the ribbon 20 has been reached. This can be in the form, as previously stated, of a conductive plastic leader or a wire imbedded leader within the ribbon at the end of the print ribbon.

The cartridge receptacle or housing 124 is shown broken away for receipt of the ink cartridge 126. Furthermore, the spool 14 has been shown without the ink cartridge blocking it. Solenoids 41 have been shown which cause the pumping of the ink to be described hereinafter.

A housing 146 covers the pumps set forth hereinafter. Underlying the housing are a number of supports for the re-inking elements. The supports support the reservoir roller 36 and manifold and cover 38 which is fed by tubes seated in tube carriers or channels 148. The tube carriers 148 allow the tubes from the pumps to be fed upwardly. The tubes deliver ink through tubes into the manifold 38 in the respective three locations namely locations, openings, or conduits 150, 152, and 154.

In order to transfer the ink to the ribbon 20, a transfer roller 156 which is hidden substantially from view in FIG. 3 has been shown. A pressure roller 160 journaled into two pins or axles 194 is utilized to pressure the ink ribbon 20. Removal of excess ink is helped by a de-inking roller 162. The de-inking roller 162 can be increased into multiple rollers if greater de-inking is required. To this extent a further de-inking roller can be levered to engage or disengage the ribbon to provide greater or lesser de-inking.

Figure 4:
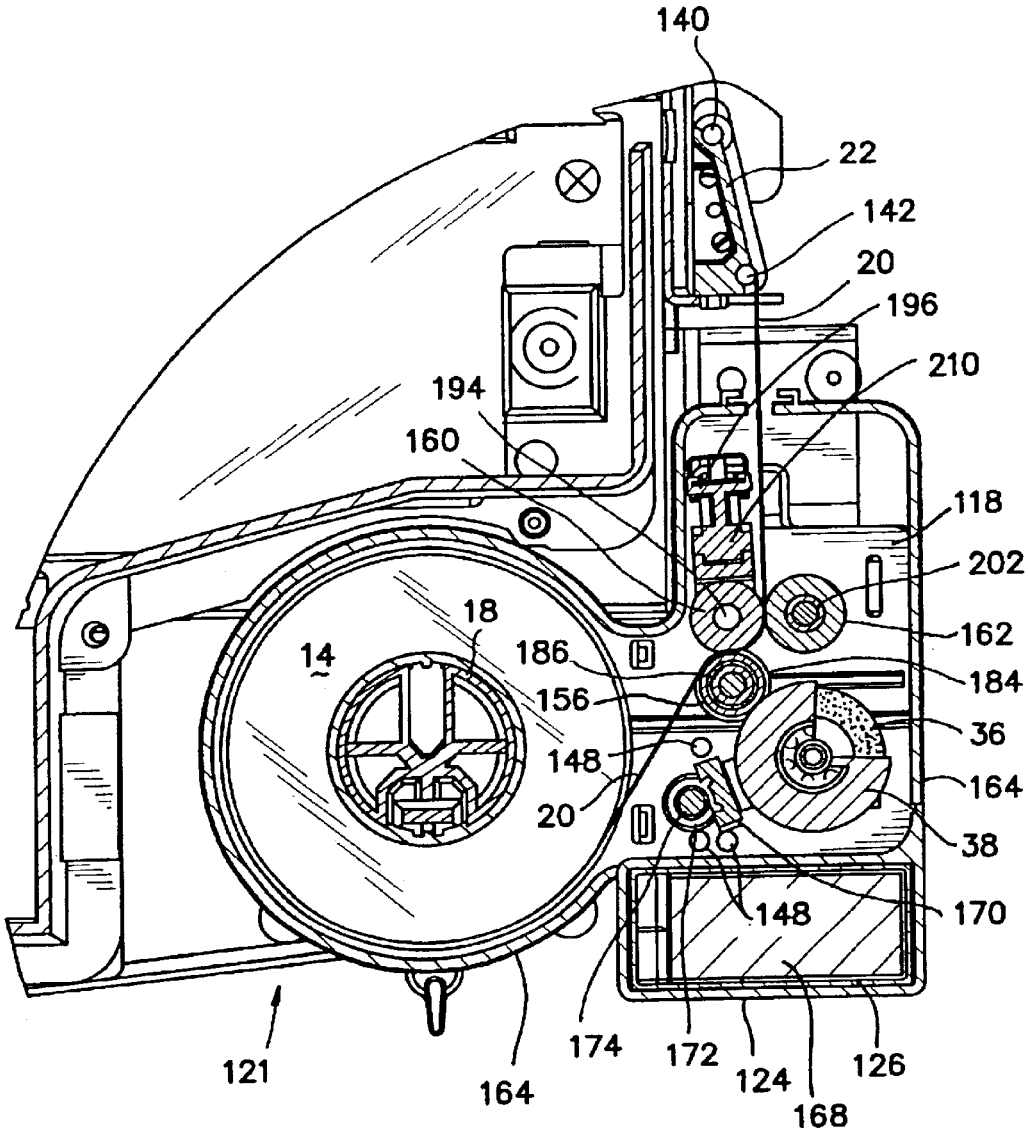
FIG. 4 shows a sectioned view looking downwardly on the re-inker.

Looking more particularly at FIG. 4, it can be seen that the ink cartridge and general re-inker module 121 is shown emplaced in a sectional plan view. The module 121 includes the spool 14 overlying the hub 18. A walled surrounding and housing established by a wall 164 is shown that has been sectioned that surrounds the various components.

The platform 118 is shown with the previously described components mounted thereon.

The ink cartridge 126 is shown in place within the cartridge holder or housing 124 with ink in place within the intermediate portion that can be held in a bag-like container. In effect, a bag-like container with ink can fit within the ink cartridge interior 168.

The reservoir roller 36 is shown with the manifold and cover 38 overlying it. In order to engage the reservoir roller 36 into a contacting position with the transfer roller 156, a plastic frame and support 170 is utilized. This plastic frame and support 170 is held by a shaft 172 driven by a torsion spring 174 in order to move it against its adjacent transfer roller 156. The shaft 172 is effectively turned by the torsion spring 174 so that in the view of FIG. 4, counterclockwise movement is effected against the adjacent roller 156.

In order to provide for delivery of ink, the plurality of tube conduits or holders 148 are shown.

The re-inking throughput is driven by the ribbon motors that move the ribbon between the spools 14 and 16 as driven by the hubs 18 and 19. This causes movement through the rollers so that the inking can be applied. The ink fundamentally transfers from the reservoir roller 36 to the transfer roller 156 as they roll against each other. The ink then transfers to the ribbon 20 at the ribbon transfer roller 156.

Looking more particularly again at FIG. 4, it can be seen that the transfer roller 156 has been shown. The transfer roller 156 has an axis that turns on a pin 186 which supports a plastic substrate 184. The roller 156 turns and specifically provides for transfer of ink from the reservoir roller 36 to the ribbon 20.

The reservoir roller 36 has multiple segments that are layered composed of absorbent elastomeric material such as PORELON®, or other foamed polyether, polyurethane, polyesterurethane types of porous material. The segments of the reservoir roller are bonded together with an impermeable adhesive or polymer film layer. Thus, fluid, in one embodiment, cannot flow from one segment of the reservoir roller to the other. The pore size, porosity, absorbency and density of the roller segments can be independently established so that particular flow characteristics for each segment can be achieved. This will be detailed in the figures hereinafter.

The transfer roller 156 comprises a foamed polyurethane or other porous type of elastomeric cylinder. The surface is coarsely ground in order to provide a porous or textured surface. Ink can then be maintained near the surface within the porous or textured surface. The material of the transfer roller 156 can be produced in a closed cell foaming process with internal bubbles. By roughly grinding the surface of the roller 156, the bubbles near the surface are severed producing a more textured and absorbent surface. This design provides improved absorbency with sufficient stiffness to force the ink into the ribbon as it is pinched by a pressure roller described hereinafter. Any texturing or degree of surface variations to maintain a greater quantity of ink on the surface of the roller 156 can be utilized.

It should be understood that any type of material for the reservoir roller 36 and the transfer roller 156 can be utilized. The necessary component is to assure that the ink can be transferred properly from the reservoir roller 36 at a relatively high speed while at the same time avoiding smudges and excess ink.

In order to effect a proper nip or squeezing of the transfer roller 156 against the ribbon 20, a pressure roller 160 is utilized. The pressure roller 160 is supported on an axle, or a pair of pins 194 on either end. The pressure roller 160 is biased by a leaf spring 196 and pivoted on a gimbal support 210 that will be detailed hereinafter in FIG. 13.

The pressure roller 160 can comprise an acetal or other hard plastic cylinder. The spring load is provided which squeezes the ribbon 20 against the transfer roller 156. The radial force through the gimbal support 210 as described hereinafter in FIGS. 5, 5*a*, and 13 squeezes the ribbon 20 sufficiently to force the ink off the surface of the transfer roller 156 into the ribbon 20.

An alternative embodiment of the pressure roller is detailed hereinafter in FIG. 16 as to the spring biasing functions.

In order to remove any excess ink, the de-inking roller 162 is shown supported on a pin or axle 202. The de-inking roller 162 comprises a foam or other surface modified polymer. Such polymers can be ACQUELL® or PORELON®. The function of the de-inking roller 162 is two fold. Firstly, it removes excess ink from the surface of the ribbon 20 in areas of the ribbon where excess ink accumulates due to re-inking and non-printing. It is usually of such a nature however, that it will not remove so much ink as to defeat the purposes of the re-inking that is to be carried on. Secondly, the de-inking roller 162 will aid in the diffusion process which tends to evenly distribute ink over the entire ribbon width over a period of time. While one de-inking roller 162 has been shown, multiple de-inking rollers can be utilized in tandem, parallel or in series. Each of the de-inking rollers, when in multiple numbers, can be engaged or disengaged depending upon the type of ink and degree of de-inking required. However, in some cases, depending upon conditions, a de-inking roller might not be necessary.

Figure 5:
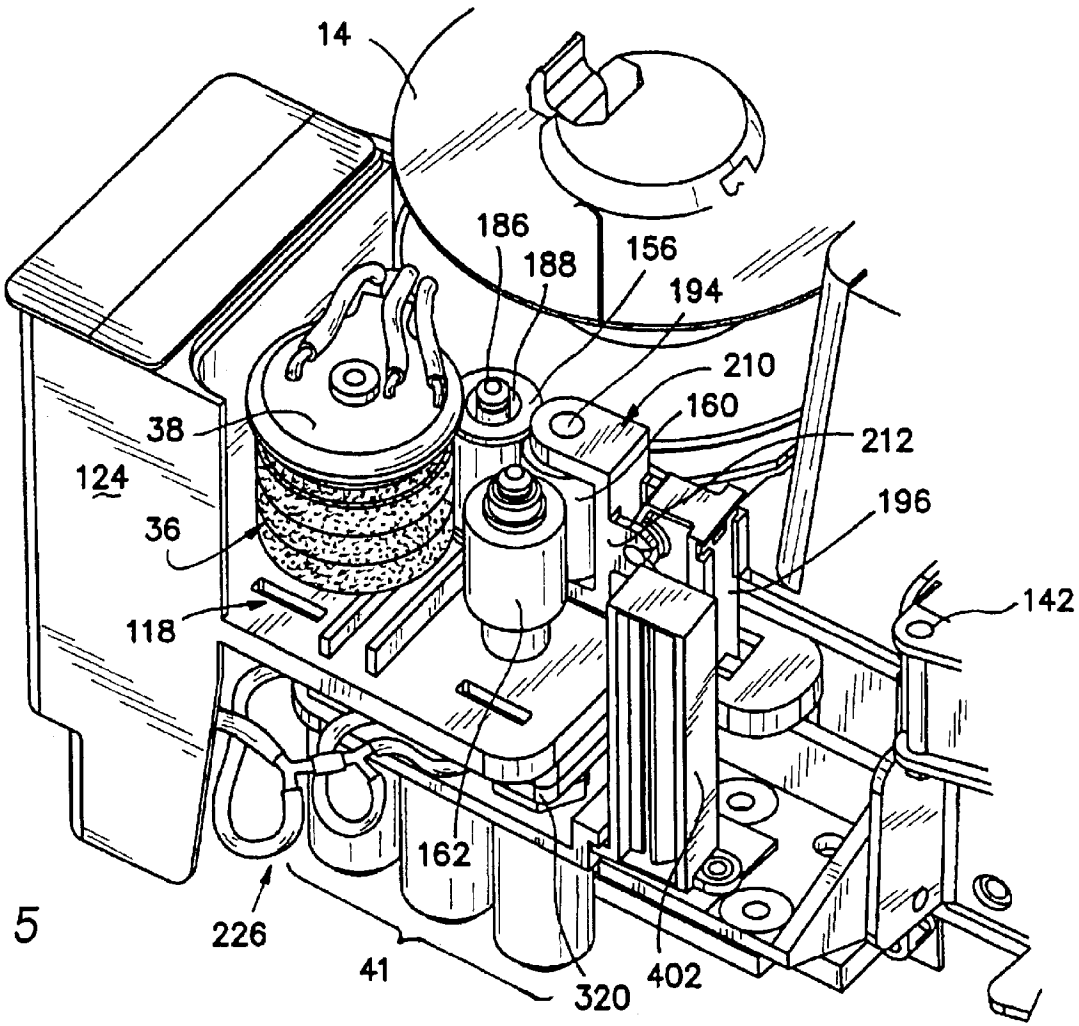
FIG. 5 shows a fragmented perspective view of a portion of the re-inker that forms the constant density printer according to one embodiment of the invention.

FIG. 5 shows the fragmented re-inking module with the reservoir roller 36, transfer roller 156, and pressure roller 160. The de-inking roller 162 is also shown. As can be seen from the plan view, the pressure roller 160 is supported on pins or an axle 194. The pins 194 are supported on a gimbaled U-shaped bracket 210. The gimbaled U-shaped bracket 210 is supported by a pair of ears 212. The U-shaped bracket 210 has an upper portion and a lower portion through which the pins or axle 194 are supported for rotation of the pressure roller 160.

Figure 13:
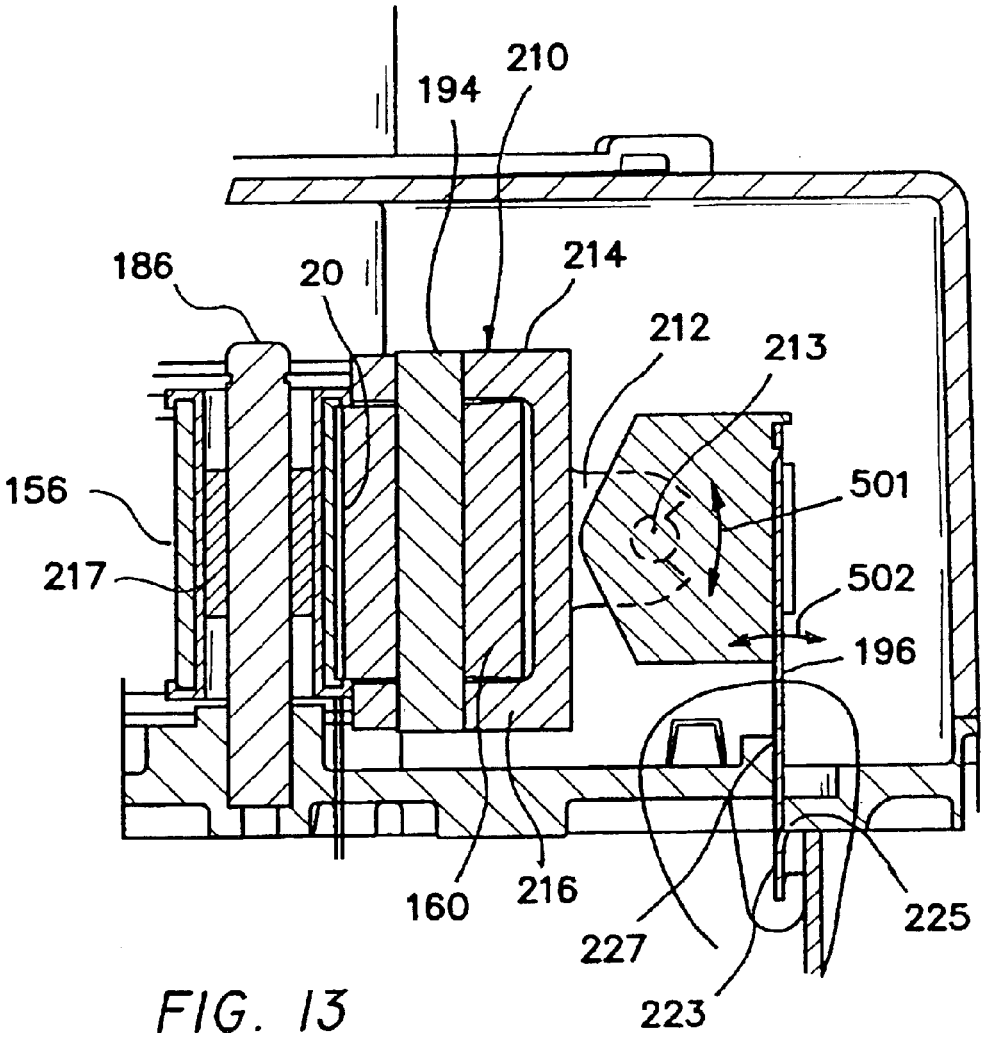
FIG. 13 is a sectional view showing the movement of the pressure roller against the ribbon during the re-inking process.

Looking more particularly at FIG. 13, the pressure roller 160 can be seen supported on ears 212 by a pin 213. The ears 212 on the U-shaped bracket 210 permit movement in the direction of arrow 501 shown as a pivoting movement around pin 213.

The leaf spring 196 forces the pressure roller 160 against the ribbon 20. This movement is seen in the direction of arrow 502 as shown. Any type of forcing or biasing can be utilized to drive the pressure roller 160 against the transfer roller 156.

In order to drive the ink from the relatively porous, textured, relieved, or striated rubber configuration of the transfer roller 156, the force of spring 196 drives the pressure roller 160 against the ribbon 20. The transfer roller 156 is supported by a shaft 186 as previously stated and has a needle bearing 217 for supporting the transfer roller. The shaft 186 can be of steel and the hub can be of a plastic or any other suitable material.

The pin 213 supporting the pressure roller 160 can be substituted by a bearing, bushing, or other configuration to allow rotational movement in the form of a gimbal in the direction of arrow 502 under the force of leaf spring 196. This allows the orientation of the pressure roller 160 to align itself and properly press the ribbon 20 with respect to the ink transfer roller 156.

The pressure roller 160 can be made of a hard plastic or other suitable material for driving the ribbon 20 against the transfer roller 156. The leaf spring 196 can be connected by means of a stamped tab 223 that is secured underneath a portion of the base or housing at point 225. Any other particular type of spring can be utilized to allow the forcing of the pressure roller 160 against the ink ribbon 20. The result of the given design provides a fulcrum at point 227 against which the spring functions to drive the pressure roller 160.

Figure 5A:
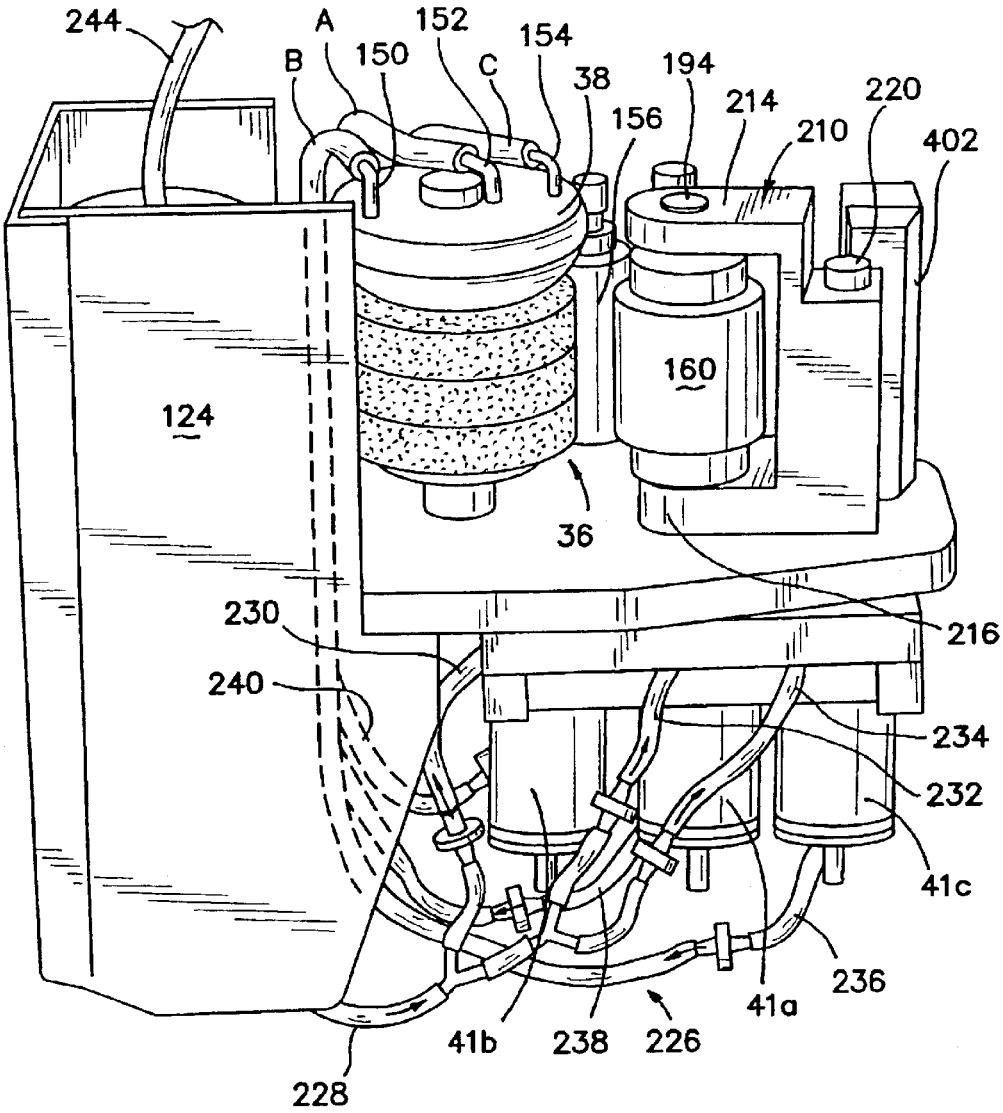
FIG. 5A shows a side elevation view of the re-inker shown in FIG. 5 with the respective ink flow conduits to the ink pumps.

As an alternative, in FIG. 5A, to permit the U-shaped bracket 210 holding the pressure roller 160 to rotationally move against the transfer roller 156, it is supported on an axis provided by a pin 220. A torsion spring can provide a force to allow for movement in some cases around the pin or axle 220. However, it can also be substituted with regard to a spring biasing member, a pin, or gimbaled member in order to allow rotation against the transfer roller 156.

Figure 16:
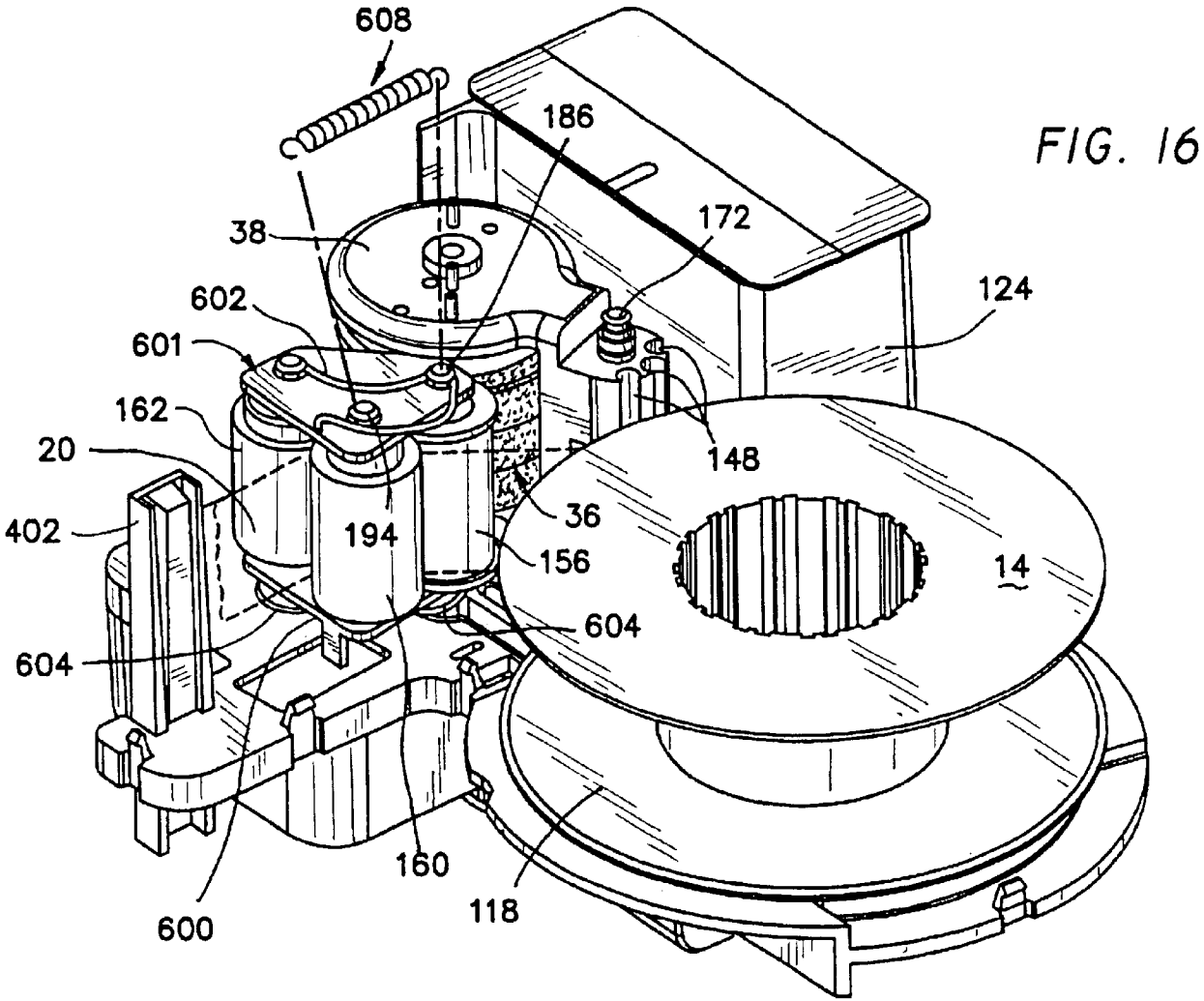
FIG. 16 is a perspective view of an alternative embodiment for spring biasing the pressure roller.

An alternative embodiment for biasing the pressure roller 160 against the transfer roller 156 is shown in FIG. 16. In this particular showing, it can be seen that an axle or pins 186 are such where they receive the transfer roller 156 for rotational movement in concert with the roller 36.

Pressure roller 160 is supported on pin or axle 194. Both of the rollers 156 and 160 are mounted on a lower plate 600 and an upper plate 601 along with the de-inking roller 162. The print ribbon 20 can be seen passing from the de-inking roller 162 and the pressure roller 160 after it has passed from the spool 14 over the transfer roller 156.

In order to spring bias the pressure roller 160, a leaf, coil or wire D- or C-spring 602 is utilized to secure the rollers 156 and 160 into nipping compressed relationship with the ribbon 20. This is effected by the spring 602 being in a contracting spring biasing relationship to move the axle or pins 194 in the direction of the transfer roller pins 186.

A like spring function is seen on the extensions of the pins or axles 186 and 194 in the form of the spring 604 which underlies the mounting plate 600.

The pressure roller 160 with the various spring biasing functions can be substituted in some cases with a compliant roller which has a relatively compressible and resilient nature. In this manner, the compliant, or compressible material can effect a resilient pressure against the ribbon and the transfer roller 156. The need for the spring biasing would then be reduced or eliminated.

As an alternative, coil springs 608 can be substituted which are respectively connected or hooked to the respective pins 186 and 194 at their upper and lower ends. This has been shown in expanded translated form for securing the pins and the respective rollers 156 and 160 into a nipping pressure relationship against the ribbon 20. The springs 608 should provide sufficient tension to move rollers 156 and 160 into close relationship.

Looking again at FIG. 5A, it can be seen that a number of tubes or conduits have been shown. These are somewhat hidden from view in FIG. 5. These conduits are shown with flow from the ink cartridge within container 124 through tube 228 which splits at a pair of Y-shaped bends in order to pass the ink in the direction of the arrows with respect to three particular tubes 230, 232, and 234. These respective tubes 230, 232, and 234 allow ink to flow through pumps that are driven by the solenoids 41.

The solenoids are labeled 41 C, A, and B corresponding to the flow of ink driven by respective pumps that deliver ink to respective flow portions of the manifold 38 and reservoir roller 36. The ink after being driven through the pumps as described hereinafter flows to the manifold 38 through tubes 236, 238, and 240 that emanate respectively as the tubes seen on the top of the manifold 38. These tubes then feed into the manifold 38 to a respective segment of the ink reservoir roller 36 in order to ink a particular segment in a controlled manner on the ribbon 20. These respective tubes 236, 238, and 240 feed into feeder elbows that can be elbows or pipes previously set forth as openings or conduits, 150, 152, and 154.

In order to clarify the ink path, the designation of paths A, B, and C will be utilized with regard to the flow of ink into the reservoir roller 36 segments as well as through the tubes 236, 238, and 240. This will also enable the flow to be qualified with regard to the flow patterns of the spool and manifold as set forth hereinafter. In particular, the introductory conduit elbow or tube 150 is designated as flow path B, conduit or elbow 152 is designated as flow path A, and conduit or elbow 154 is designated as flow path C. These respective flow paths feed into the spool and manifold configuration detailed hereinafter in FIGS. 6, 7, 8, and 9.

Figure 6:
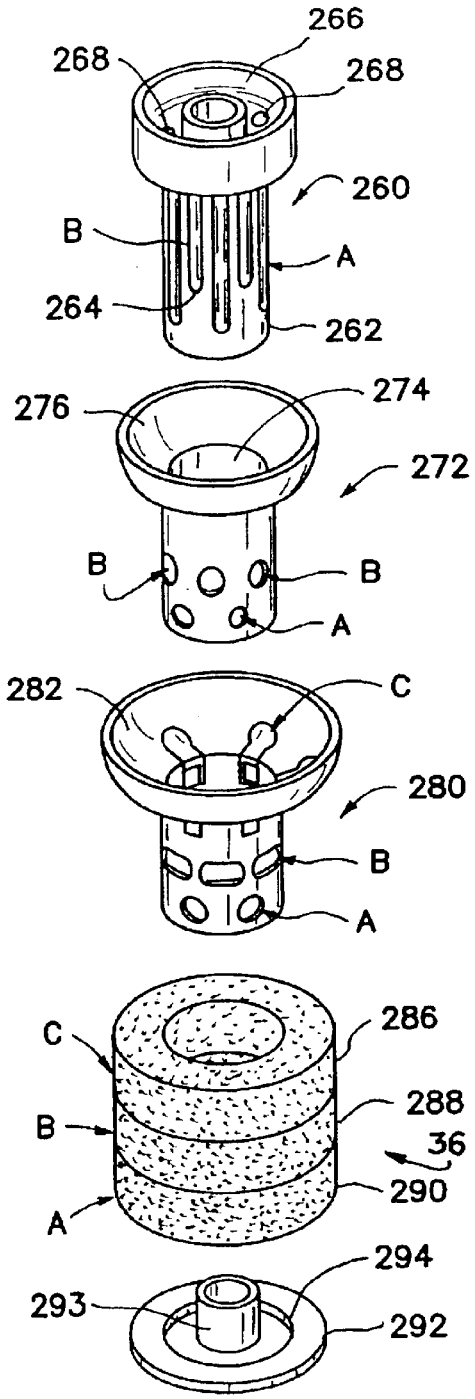
FIG. 6 shows a perspective exploded view of the re-inker spool and re-inker reservoir roller which receives ink from the interior of the spool.
Figure 7:
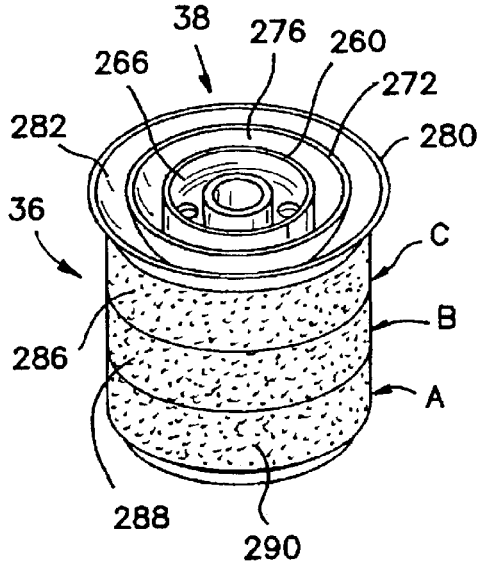
FIG. 7 shows a perspective assembled view of the re-inker spool and reservoir roller.

Looking more particularly at FIGS. 6 and 7, an interior spool, hub, spindle, or cylinder 260 is shown. The spool 260 has channels 262 and 264 that are longitudinally oriented to allow for flow downwardly from a cup shaped area 266 forming part of the manifold. The cup shaped area 266 of the spool has a circumferential channel, annular groove, or round trough like opening into which ink can flow so that it can be distributed along the length of channels 262 and 264. The elongated channels 262 in part comprise flow path A for the ink. The shortened channels 264 comprise in part flow path B. The ink flowing into the channels 262 and 264 can be seen associated with a opening 268 for flow directly into the channels 262 and 264 which is the direction respectively of flow paths A and B.

The spool 260 is inserted, sealed, or pressed fit into the interior of a second or intermediate spool, spindle, cylinder, or hub 272 having an opening 274 for communication with the channels of spool 260. The respective spools are pressed fit or sealed together so that a cup like area or annular groove 276 can establish an area for receipt of ink between the outer portion or walls of the cup-shaped area 266 and the interior of the walls of cup-like area 276.

The intermediate spool 272 has a plurality of openings or ports which correspond to the channels 264. These constitute the path where the ink can flow in the direction of flow path B.

Lower ports of the intermediate spool 272 allow for the flow of ink in the flow path of direction A along the channels 262.

Thus, ink flowing into the cup-shaped area 266 can flow downwardly through the openings 268 and outwardly through ink flow paths A and B depending upon the respective location of the channels 262 and 264 that match the ports with flow paths A and B of the intermediate spool or intermediate middle manifold hub. In effect, the ends of channels 262 and 264 are indexed to and correspond to ports or outlets of the hub 272 for flow paths A and B.

The foregoing two hubs 260 and 272 are pressed fit into an outer hub or spool 280. The outer hub 280 receives flow through a cup established in the form of a cup, annular channel, or circumferential groove 282 between it and the outer wall of the cup-like area 276 of the intermediate hub 272. In one embodiment, the hubs have alignment grooves or marks such that each of the openings in the hubs correspond to each other to facilitate the proper flow of paths A, B, and C.

Flow is allowed downwardly for ink flow path in the direction of flow path C. This delivers ink to the uppermost portion, segment, or disc of the reservoir roller 36 as will be set forth hereinafter. Here again, outer hub or spool 280 has corresponding openings to allow the flow in the direction of flow paths A and B in the pressed fit relationship so ink can flow from the channels 262 and 264. Ink from the channels 262 and 264 flows out through the intermediate hub 272 through respective flow paths A and B in connected relationship to the reservoir roller 36. These flow paths are through and indexed to the outer hub 280 so final flow paths A and B of the outer hub will allow ink to flow outwardly and finally into the reservoir roller 36.

The reservoir roller 36 comprises layers, discs, segments, or portions 286, 288, and 290. The foregoing are seated on an end cap or bushing plate 292 having an O ring 294 for sealing the respective spools 260, 272, and 280 within the interior of the material forming the reservoir roller 36 and onto the end cap 292.

The reservoir roller material constitutes an absorbent elastomeric material such as PORELON®, foam polyether, urethane, or polyesterurethane felt. These segments of the reservoir roller 36 namely discs or segments 286, 288, and 290 are bonded together with an impermeable adhesive or polymeric film layer. In this manner, the ink cannot readily flow from one segment to the other.

The pore size and density of the roller segments 286, 288, and 290 are independently controlled so that particular characteristics can be achieved for each segment. The foam constituting the reservoir roller 36 insofar as segment or disc 286 is concerned causes ink to flow in the direction of flow path C; segment 288 causes flow in the direction of flow path B; while segment 290 causes flow in the direction of flow path A. These disc segments correspond to ribbon 20 segments which are sensed and maintained for purposes of re-inking depending upon their relative ink depletion.

Length of the reservoir roller 36 or the three segments, 286, 288, and 290 when combined is slightly less than the width of ribbon 20. In this manner, boundary zones exist at each edge of the ribbon within which no ink is transferred. In this way, the ink returns to the middle of the ribbon and gradually distributes itself to the boundary zones by diffusion.

With the foregoing orientation, segments, discs, or elements 286, 288, and 290 of the reservoir roller 36 provide the ability to distribute ink from the delivery channels paths or directions A, B, and C. This design can take on the aspects of independent re-inkers for re-inking particular zones or segments on the ribbon 20. Based on hammers 70 impacts, these would correspond to a vertical column on the printed page with regard to re-inking.

The effective characteristic of the invention is to provide for ink requirements depending upon the frequency of dots being printed. This proportionately supplies ink to the proper zones or segments on the ribbon 20 at roughly the right time. Inasmuch as the ink is sometimes consumed in highly localized areas of the ribbon 20, for instance as in printing bar codes or graphics, the re-inking process will unavoidably deposit too much ink in some places on the ribbon. This is remedied through the use of one or more of the de-inking rollers 162. However, depending on the ink and other conditions, a de-inking roller might not be required.

Figure 9:
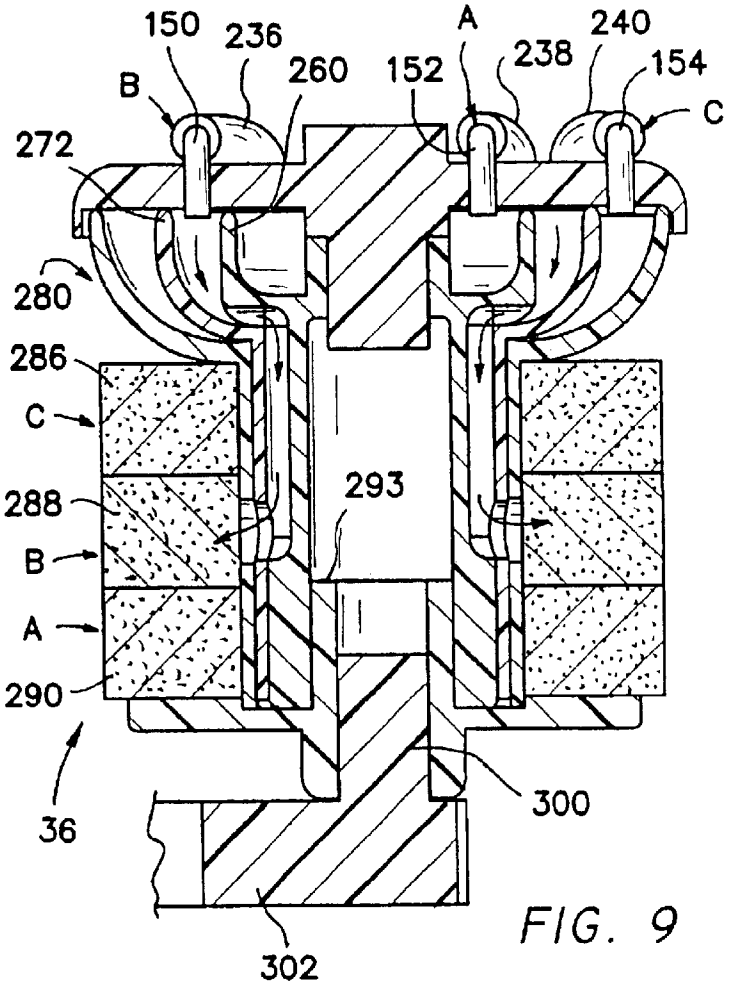
FIG. 9 is a sectioned view similar to FIG. 8 taken on a separate axis to show flow to the interior portion of the reservoir spool.
Figure 8:
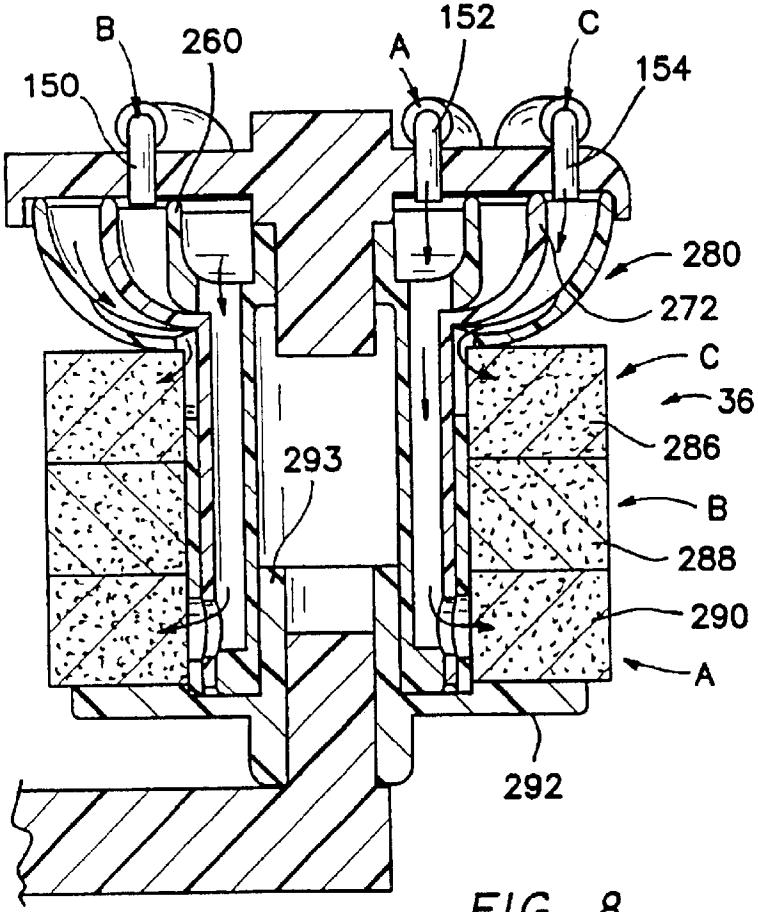
FIG. 8 shows a sectional view of the re-inker spool and reservoir roller as sectioned to show flow to two particular portions or segments of the roller.

Looking more specifically at FIGS. 8 and 9, the reservoir roller 36 and manifold has been shown with the respective conduits or elbows 150, 152, and 154 delivering the ink through the respective flow paths B, A, and C. The hubs, spindles, or spools 260, 270, and 280 are shown in their nested relationship. Flow path C is shown flowing downwardly in order to serve reservoir roller segment or disc 286. As can be seen with regard to the flow of reservoir roller segment 288, the flow path is in the direction of ink flow path B. Thus, reservoir roller segment or disc 288 receives flow path B. Finally, flow path A serves segment or disc 290. These respective flow paths of C, B, and A constitute the ink flow paths delivered upon command to maintain proper ink amounts in segments 286, 288, and 290 of the reservoir roller. These correspond to zones or segments of the ribbon 20 which is to be re-inked.

As seen again in FIGS. 8 and 9, the reservoir roller 36 is supported on a plastic pin, axle, shaft, or rod 300 which is in turn formed on a support member 302. Thus, the end cap 292 can be secured and rotated on the pin or axle 300 on its bushing or support flange 293.

The bushing or support flange 293 can be impregnated with Teflon so that proper lubricity takes place as it rotates on the plastic shaft or axle 300.

Figure 10:
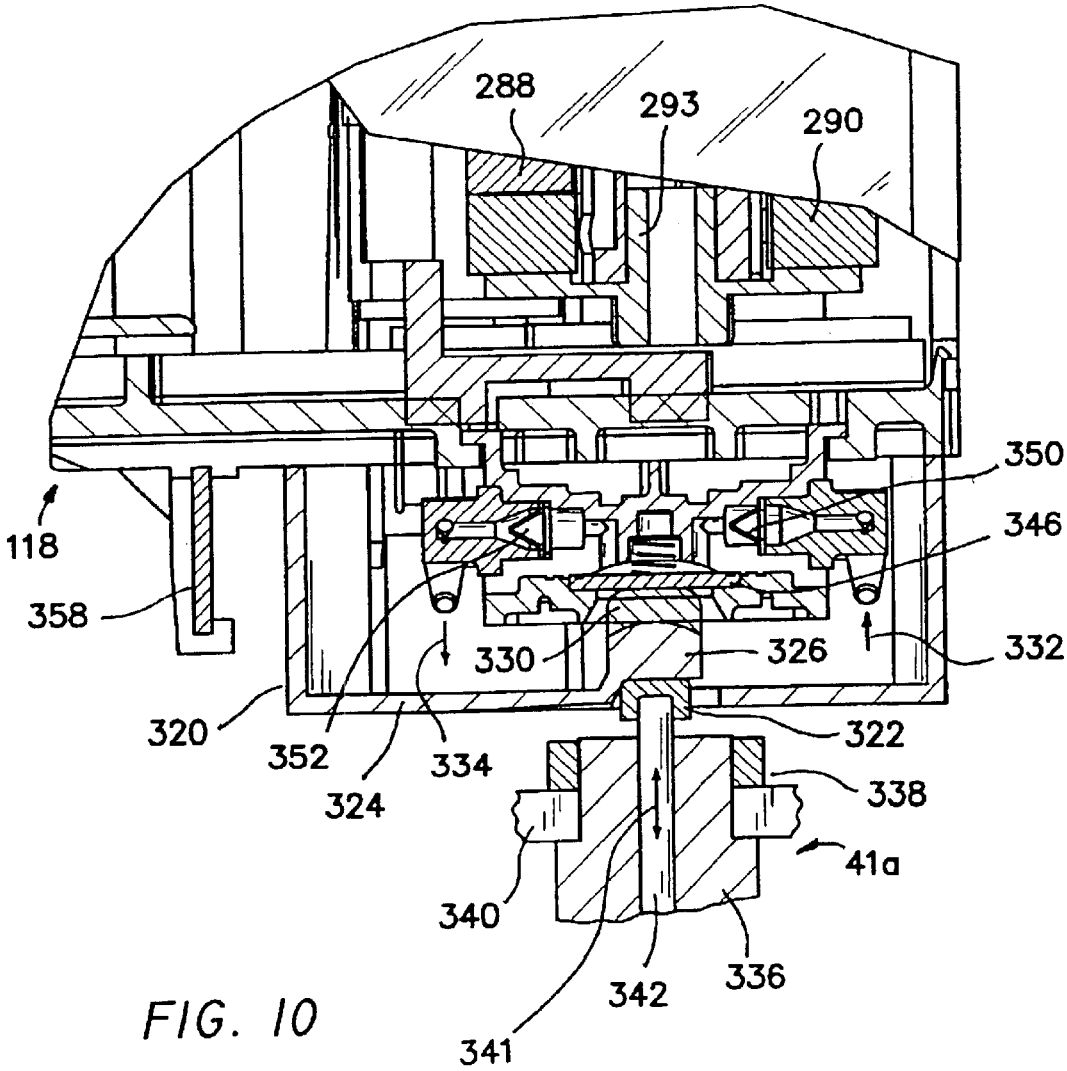
FIG. 10 shows a sectional view of a pump which feeds ink to a particular reservoir roller.
Figure 10A:
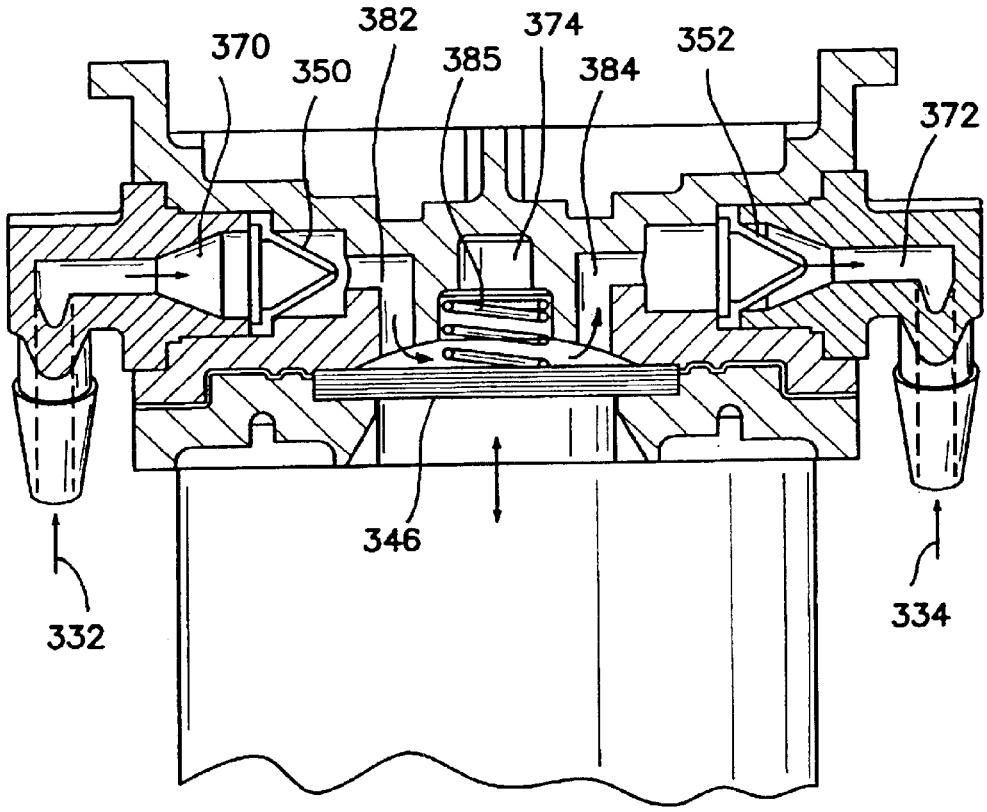
FIG. 10A is a sectional view detailing the pump in the opposite direction from that shown in FIG. 10.

Looking more particularly at FIGS. 10 and 10A, it can be seen that a pump of the re-inker unit is shown. The pump is such where it is placed in a housing underneath a platform 118 and is serviced respectively by solenoids 41C, 41A, and 41B, although only solenoid 41A is shown. In particular, each solenoid 41C, 41A, and 41B has a pump overlying it to respectively service the ink paths A, B, and C. A housing 320 is utilized overlying each solenoid 41 in order to contain a pump for purposes of pumping through the tubes 236, 238, and 240 which service the manifold 38 through elbows or fixtures 150, 152, and 154. Each flow path C, B, and A is served by a corresponding pump out of the group of three pumps serviced by each solenoid 41C, 41B, and 41A.

Each solenoid 41C, 41B, and 41A has a housing 320 overlying it with a pump therein. The pumps are serviced by the solenoids through an actuation of a shaft or core. FIGS. 10 and 10*a* show one of the solenoid's core that moves upwardly and downwardly in the direction of an arrow 341. This movement causes a plastic tip 322 to drive against an actuator arm 324 having a rounded knob, enlargement, or contact member 326.

Contact member 326 generally seats against a plunger driver 330 which contacts a diaphragm 346. When actuated, this allows the ink to flow in the direction of arrow 332 that would be connected to one of the tubes such as tubes 230, 232, and 234. The flow outwardly would be in the direction of arrow 334 which serves one of the tubes 236, 238, and 240. Thus, for each tube segment having an inlet and an outlet, a respective pump in the housing 320 is utilized overlying a respective solenoid 41C, 41A, and 41B to be driven by a solenoid coil 336. The solenoid coil 336 is held in place by a mounting nut 338 to secure it to a bracket 340.

When the shaft of the solenoid such as shaft 342 is actuated in the up and down direction of arrow 341, it drives the elastomeric diaphragm 346. This drives ink flow in the direction of arrows 332 and 334 through the pumps. The one way flow is enhanced by two duck bill check valves 350 and 352 which maintain flow in the direction of arrows 332 and 334 as ink passes therethrough. Any one way valve system can be utilized such as diaphragms, poppets, mushroom valves, and the like to create the directional flow of the ink. In effect, the housing 146, when the re-inker module with the pumps in housings 320 is seated over each respective solenoid 41C, 41A, and 41B, is prepared to urge ink to flow through the respective tubes when being pumped.

In order to determine the count of the unit, a printed circuit board 358 is utilized with a processor to store a count of the unit and the values of the amounts being pumped from the ink cartridge 126.

A reverse view from FIG. 10 is shown in FIG. 10A. The flow outwardly in FIG. 10 can be seen in the direction of arrow 334 while the flow inwardly is seen in the direction of arrow 332. To this extent, the duck bill valves 350 and 352 are also shown with the direction of ink passing therethrough. This flow is further detailed as seen through the introductory conduit 370 and outlet conduit 372. An internal chamber 374 is shown overlying the diaphragm 346. The respective passages into the chamber 374 are the internal inlet passage 382 and internal outlet passage 384. These cause the flow in the respective direction of arrows as checked by the duck bill valves 350 and 352. Duck bill valves can be substituted with any type of check valve or other type of valve in order to allow the diaphragmatic or any other type of pump action for the flow provided herein.

In order to cause the diaphragm 346 to move with precision and avoid hysterisis, a coil spring 385 is utilized to cause the diaphragm to return. Other types of pumps can be used such as a plunger, snap over diaphragm, piston, ball pump, peristaltic pump, squeeze tube pumps, and many others for ink flow.

Figure 10B:
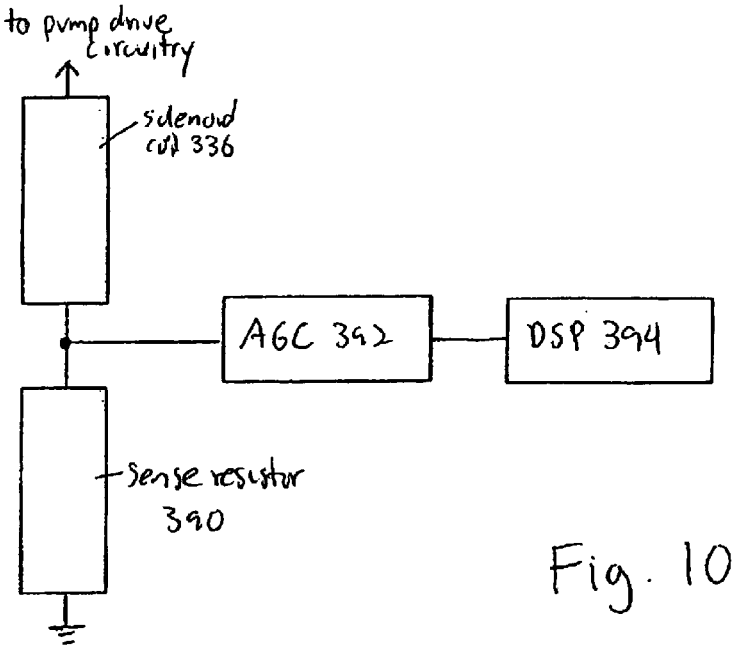
FIG. 10B shows a block diagram of an ink-out detection system according to one embodiment.

FIG. 10B shows a block diagram of an embodiment of the invention for detecting an ink-out condition in the print system, according to one embodiment. The ink-out detection system includes solenoid coil 336 (as part of solenoid 41), which is coupled to circuitry that drives shaft 342 (FIG. 10) for pumping ink from ink cartridge 126 through ink tubes 230, 232, 234 and out of ink tubes 236, 238, 240, as described above. Coupled to solenoid coil 336 is a current sensing resistor 390, an analog-to-digital converter (ADC) 392, and a digital signal processor (DSP) 394, which can be included in PCB 358. ADC 392 measures the electrical current as seen by the voltage across sensing resistor 390 and converts the analog current value to a digital value, as is known in the art. The digital current value, or corresponding voltage, over the actuating time is stored and processed by the DSP 394.

When ink cartridge 126 is out of ink, a vacuum is pulled due to the one way flow caused by check valves 350 and 352 (FIGS. 10 and 10A), resulting in elastomeric diaphragm 346 not returning to its normal position, i.e., the vacuum pulls diaphragm 346 up towards coil spring 385. This causes a change in the mechanical load on solenoid shaft 342 during its upward movement. Because solenoid shaft 342 is electromechanically coupled to solenoid coil 336, a different current profile is created during the upward travel when the ink is depleted as compared to the current profile when ink is remaining.

Figure 10C:
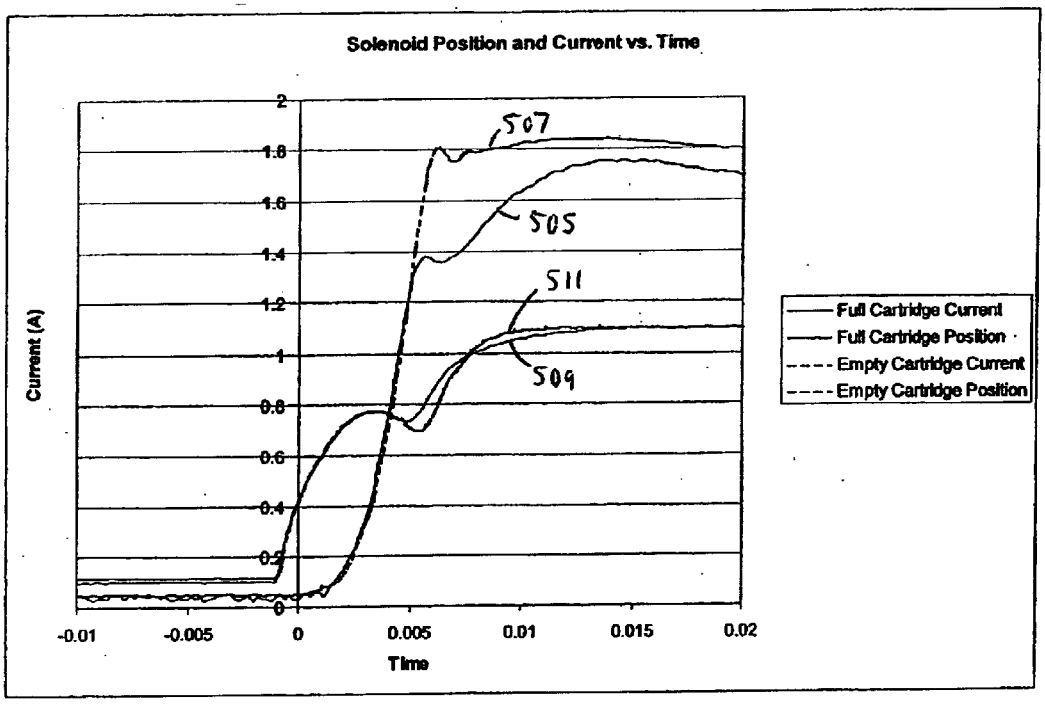
FIG. 10C is a plot showing the current and position of the solenoid for both a full ink cartridge and an empty ink cartridge as a function of time.

FIG. 10C is an exemplary plot showing the current profile, as well as the position of the solenoid, as a function of actuating time for both an empty and a full ink cartridge. Line 505 indicates the position of a full ink cartridge, line 507 indicates the position of an empty ink cartridge, line 509 indicates the solenoid current associated with a full ink cartridge, and line 511 indicates the solenoid current associated with an empty ink cartridge. As seen from FIG. 10C, the current profiles between a full ink cartridge condition and an empty ink cartridge differs. This difference or profile change is monitored by DSP 394. Based on this, when DSP 394 determines that the ink is depleted, an indication is made, thereby allowing the user to refill or replace the ink cartridge. The indication of "ink-out" is made only when the ink is completely depleted from the ink container or bag. Consequently, the ink does not to be re-filled when the ink is not completely depleted, as with conventional methods, thereby resulting in a lower number of times needed to re-fill the ink container for a given number of print passes. In other embodiments, solenoid coil 336 may be replaced on any electromechanical device used to actuate the ink pump, such as a rotary motor.

FIGS. 11 and 12 show the ink box or container 124 with the ink cartridge 126 therein holding a given amount of ink 168. The ink cartridge 126 is served by a main exit conduit 392. The main exit conduit 392 can have a flared fitting 394 to which a tube can be attached which delivers ink to the respective pumps within the housings 320. The ink cartridge 126 has an extended tubular portion 396 which extends into a tube member 398 so that ink can flow downwardly and not be disposed at the interface.

The tube 396 of the ink cartridge incorporates a septum 400 which is pierced by a needle 402 when the ink tube depends downwardly and the septum is pierced. This can be seen more clearly in FIG. 12 wherein the septum 400 has been shown as a sectioned elastomeric member that can be pierced. When the septum 400 is pierced, flow is permitted through the tube fitting 392 as interconnected with the needle 402. Thus, it is merely necessary to emplace the ink cartridge 126 within the ink box 124 and allow the ink 168 to flow through the needle 402 once the septum 400 is pierced.

Flow of the ink passes out through the connection 392 in the direction of tube 228 which interconnects with the tubes 230, 232, and 234 for pumping of ink. Tube 228 is shown disassociated from the flared fitting 394 in FIG. 12 but would normally be connected to allow for the flow of ink in the direction of the arrow shown therebetween.

Figure 14:
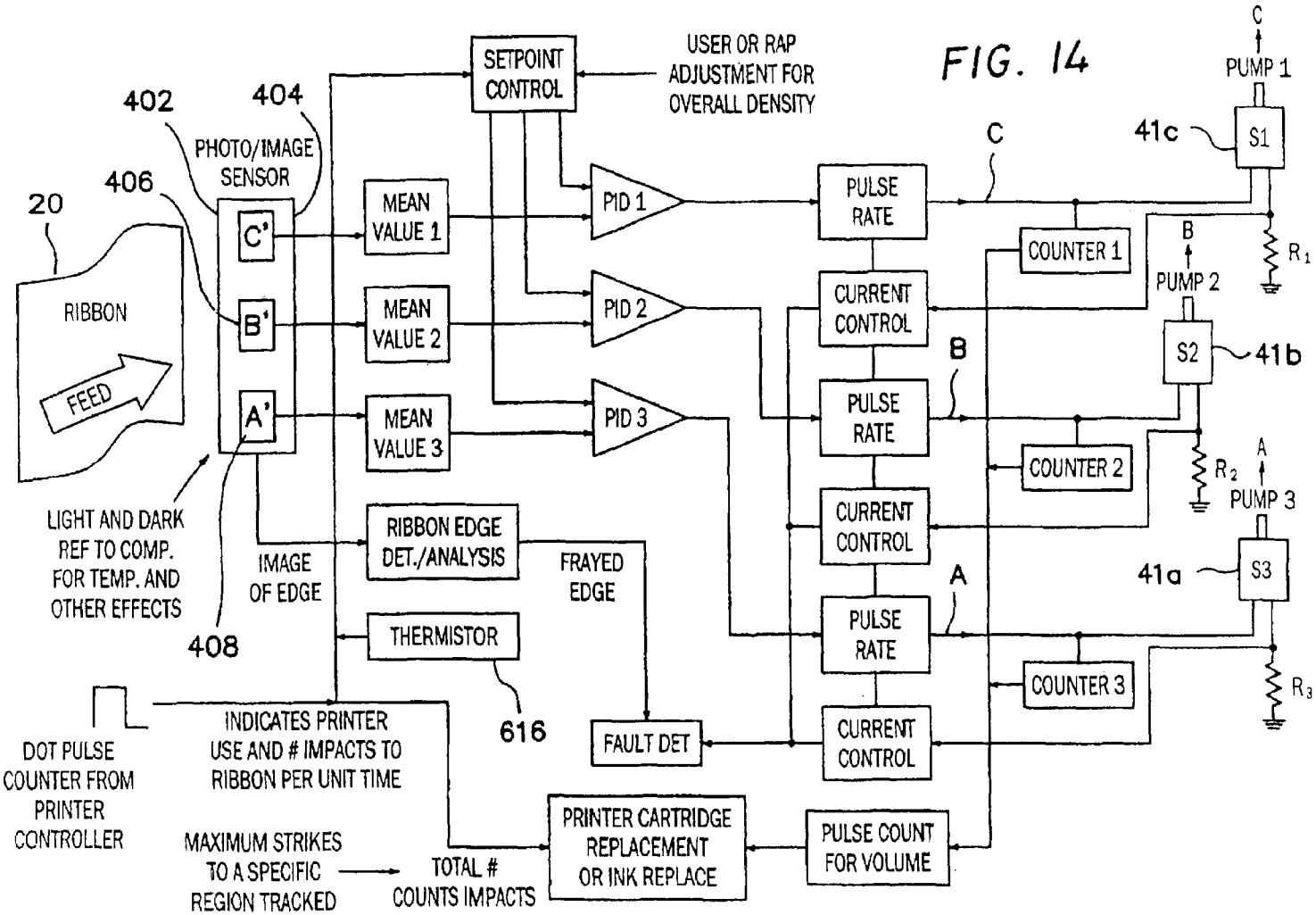
FIG. 14 shows a block schematic view of the controls and processes for implementing one embodiment of the invention.

Looking at FIG. 14, it can be seen that a schematic has been shown of the system and re-inker module. In particular, FIG. 14 comprises the system for determining the amount of ink on the ribbon and adjusting the flow of the ink through the respective pumps. In this instance, it is seen that the ribbon 20 moves in the direction of the feed in direct juxtaposition to a photo image sensor 402. This photo image sensor is shown as image sensor 402 in FIGS. 5 and 5*a*.

The photo image sensor 402 can be positioned at any location in order to provide for the reading of the amount of ink on the ribbon 20. The photo sensor utilizes the degree of reflection reflected from the ribbon 20. This is done by means of a plurality of light emitting diodes and diode sensors. The light emitting diodes cast a light on the ribbon 20. This light is then sensed by a reflection back to the series of photo sensors on the photo image sensor.

Any particular type of light can be utilized in order to provide for the reflection. Also, any particular type of sensor can be utilized as long as it determines the degree of reflectance of the ink ribbon 20.

The degree of reflectance with regard to a white surface would be close to or at 100% of reflection. With regard to a perfectly black inked surface, the reflectance would approach zero. In some cases, complete absorption of light on the ribbon would cause no reflectance. In many cases there is a degree of reflectance predicated upon the aspects of the liquidous nature of ink. Thus there is a certain empirical aspect to the reflectance which is not absolutely determined by calculations.

As a consequence, a particular setting must be established as to the degree of reflectance required to determine the amount of ink on the ribbon. Another point of note is that the amount of reflectance is relatively linear although it can vary as previously stated with regard to the liquidous nature or other characteristics of the ink. These various characteristics can be due to ink dye or ink pigment as well as the carrier which can be in the form of oleic acid.

As an aside, the reflectance can be a factor of a surface phenomenon which does not propagate through the ribbon 20. Another point of note is that ink concentrations can vary. With this in mind, various inks also have various light absorption characteristics which must be established for a particular ink. Nevertheless, when a particular reflectance is established, the light returned to the light sensors increases as a depletion of the ink on the ribbon 20 takes place. As a further factor, the reflectance can vary with regard to temperature.

Again, looking more specifically at FIG. 14 it can be seen that the photo image sensor 402 has three discrete light sensing areas 404, 406, and 408. These respective discrete light sensing areas correspond to the discrete segments of the reservoir roller 286, 288, and 290. Thus, the ink flow as established through flow paths C, B, and A are shown on the photo image sensor as the detection areas C', B', and A'. When a particular amount of ink as related to depletion of ink on a zone or segment of the ribbon is sensed by sensor 402 in segments or zones C', B', and A', a signal is sent to cause a replenishment of the ink on the related segments of the reservoir roller 36.

The mean reflection values are established from the reflectivity as mean values 1, 2, and 3 as to the degree of reflectance in order to provide for ink corresponding to ink flow paths C, B, and A. In this manner, the output of the ink can be controlled and emplaced on the ribbon 20 depending upon the degree of reflectance which corresponds to the relative amount of ink on the ribbon 20 in a particular zone or segment.

The printer 10 has a controller as in the case of most printer controllers, it can be either an on board controller or an on board controller in conjunction with a host. Regardless of the fact, the controller can count the number of pulses to indicate the printer use and the number of impacts to the ribbon 20 per unit of time. Also, the specific placement of where the ribbon 20 is being struck can be accounted for. As can be seen, with the sloping ribbon configuration of FIG. 1, it causes a striking on the ribbon at various locations across its width. The particular information as to the total number of impacts counted provides information to the printer cartridge chip for replacement of the ink cartridge 126 for the entire re-inker module. The information as to where the ribbon 20 impacts take place allows for the controller to send greater or lesser amounts of ink to a segment or zone of the ribbon through the discs, segments, or portions 286, 288, and 290 of reservoir roller 36.

In some cases, the placement of hammer impacts on the ribbon and the number of impacts can be used to control the amount of ink to be pumped to the reservoir roller 36. For special applications, the sensor can be eliminated and the control of ink flow maintained by counting the number of dots being printed and their relative placement on the ink ribbon.

In addition to the foregoing data, the upper and lower portions of the photo image sensor 402 can be calibrated to monitor the edges of the ink ribbon 20. The monitoring of the edges can establish whether the ribbon is becoming frayed or is not properly indexed with regard to the inking system. If the ribbon 20 is not being indexed with regard to the reservoir roller 36, the particular points of ink supply might not be as well determined. With this in mind, the ribbon edge and its placement with regard to the system is of importance. The data through the controller can be such where it alerts an operator or can automatically adjust the placement of the edge of the ribbon 20 so that proper inking takes place.

A user observation of the quality of print on the media 66 or a read after print automatic adjustment for the density of the ink on the ribbon 20 can be established. This can be done by various controls on the printer either through an automatic analysis of the amount of ink desired or a reading of the amount of ink and then a manual (control panel) or an automatic adjustment of the set point. In this manner, the amount of ink can be automatically established by a sensor reading the quality of the print and/or the degree of darkness or lightness so that more or less ink can then be applied to the ink reservoir roller 36. This therefore sets the set point control. In effect a further control as to print quality can be established by including a print quality verification system.

With this in mind, the set point control input to the PID 1 and PID 2 and PID 3 provides for the correct proportional output. A correct pulse rate of a particular pump for inks flowing through flow paths A, B, or C can be established. The PIDs are proportional integrational and differential devices to effect the pulse rate for the pumps as driven respectively by solenoids 41C, 41B, and 41A.

In order to establish proper operation of each respective solenoid 41C, 41B, and 41A associated with the pumps for flow paths C, B, and A, a current control to the solenoids 41 is utilized in order to prevent over driving of the pumps. Flow path pulse rates for the pumps have been shown as C, B, and A to provide for pulses to respective solenoids 41C, 41B, and 41A that are the discrete solenoids that drive the pumps 1, 2, and 3 which feed flow paths C, B, and A. Thus, the output of pump 1 driven by solenoid 41C is through the flow path C. The output of pump 2 driven by solenoid 41B is in the direction of flow path B, while the output of pump 3 driven by solenoid 41A is in the direction of flow path A.

A counter is associated with each respective pulsing of the solenoids 41 to determine the amount of ink being driven by the pumps. Thus, determination can be made of the respective amount of pump pulses and the net amount of the ink on the reservoir roller 36 and accordingly adjusted. This can be done either through an on board processor in the re-inking module or through the printer controller. Further to this extent, the pulse count can then be fed into the information requiring a printer cartridge replacement or ink replacement. This can be shown as either an output for a user or an automatic stop point to prevent any further printing.

From the foregoing, it can be seen that the photo image sensor 402 with its respective sensing of the amount of ink in ribbon zones or segments corresponding to reservoir roller segments 286, 288, and 290 can effectively create flow paths to the reservoir roller 36. This provides appropriate ink on segments corresponding to flow paths A, B, and C for correct inking at the three respective portions of the print ribbon 20. This enables a print ribbon 20 to be maintained with constant density ink over an extended period of time. The system also provides for proper lubricity of the ribbon 20.

The pumping or pulses for providing flow through flow paths A, B, and C can generally take place in increments, e.g., every five to forty seconds. However, different speeds of printing will cause the pulses to be required at either greater or lesser pulses. The entire system can form a closed loop control of ink on the ribbon 20 and appropriate print quality.

A further refinement is an optional sensing of ambient temperature by a thermistor 616. The thermistor 616 output can provide a set point in conjunction with the photo sensor 402. It can further effect compensation by providing sensor calibration for various ambient temperatures.

Figure 15:
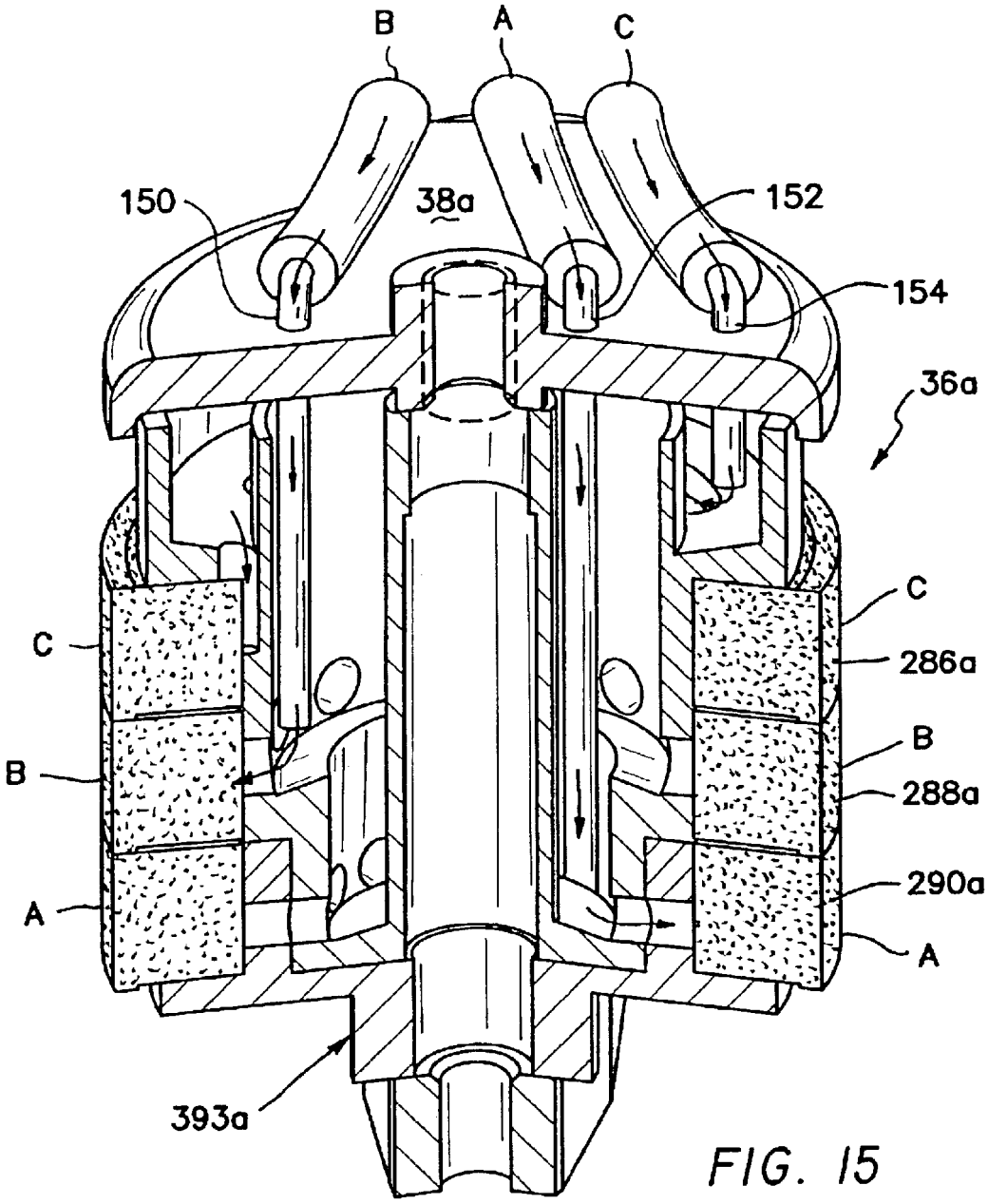
FIG. 15 is a sectional view of an alternative embodiment of the re-inker spool and re-inker reservoir roller.

Looking more specifically at FIG. 15, it can be seen that an alternative reservoir roller 36*a* has been shown. The reservoir roller 36*a* has the flow path A, flow path B, and flow path C so that flow takes place in the analogous manner of that shown in FIGS. 8 and 9. These flow paths are connected to a manifold 38*a* analogous to manifold 38.

In the showing of the flow pattern, it can be seen that tubes or flow channels flow directly to the respective discs through which re-inking takes place in the flow from top to bottom of paths C, B, A. Thus, flow path A flows directly to the bottom and out of portion 290*a*. Flow path B flows downwardly to segment 288*a* and outwardly in order to re-ink the respective ribbon segment, while flow path C flows downwardly to the highest portion 286*a*.

From the foregoing, it can be seen that a different flow path can be established from the showing of FIGS. 8 and 9 without the utilization of offset cups. Instead the direct flow is through tubular members, spaces or offset cylinders having ports. These can be molded into the spool of the reservoir roller 36*a* for appropriate flow outwardly through segments 286*a*, 288*a*, and 290*a*. Thus, as can be appreciated, various configurations and flow paths can be utilized so long as flow can take place for re-inking in segments directed toward flow A, B, and C.

Figure 17:
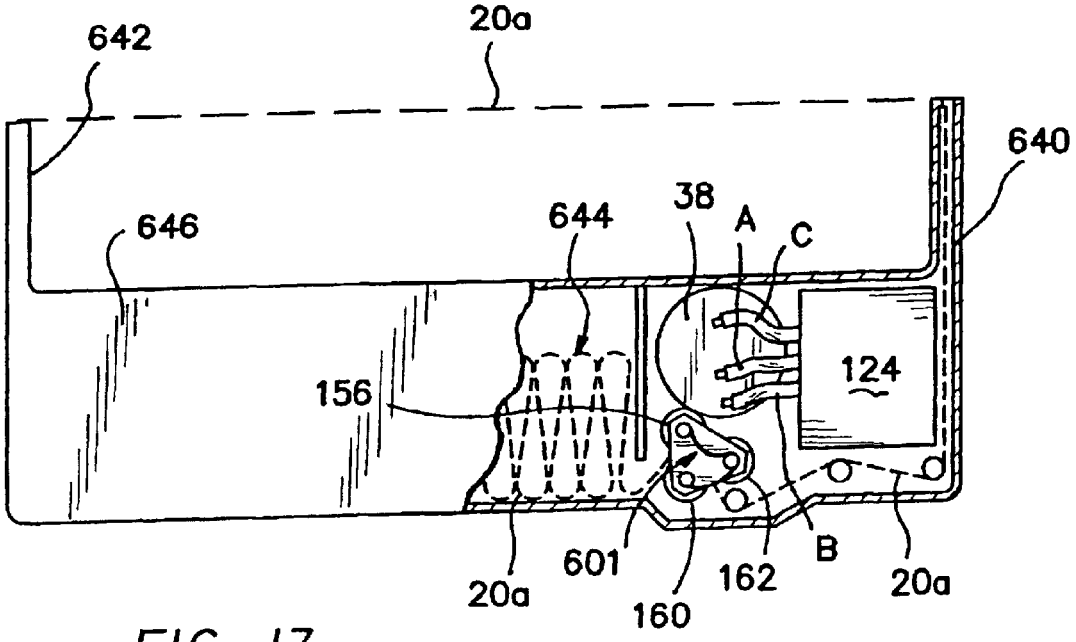
FIG. 17 is a plan view of a continuous print ribbon cartridge utilizing one embodiment of the invention.

Looking at FIG. 17, it can be seen that a continuous ribbon 20*a* has been shown. This continuous ribbon 20*a* is supported across two arms 640 and 642. These respective arms 640 and 642 support the ribbon 20*a* outwardly so that it can pass over the hammerbank in the manner shown in FIG. 1C. The ink ribbon 20*a* can be drawn, or pulled by an ink ribbon drive as shown with the respective re-inking functions. Also, it can be established as an ink ribbon accordion or pleated series of stored portions 644. The foregoing storage area of the ribbon 20*a* in the form of the pleated area 644 can be covered by a cover 646. Thus, a continuous loop of ribbon 20*a* can pass over the hammers 70 of the hammerbank for printing by the printing tips 72 while at the same time providing the re-inking by the re-inking in the prior embodiments.

The continuous ribbon 20*a* passes over the absorbent reservoir roller 36 and the transfer roller 156 which is engaged against the pressure roller 160. Rollers 156 and 160 are spring biased against each other in the manner shown in FIG. 16. The de-inking roller 162 or series of multiple rollers can be utilized.

The ink cartridge, receptacle, or housing 124 is connected in the same manner with pumps to provide flow in the direction of paths C, A, and B.

Any particular drive for moving the ribbon 20*a* can be utilized such as a roller or nipping rollers. Also, the drive can take place by driving one or more of the rollers 156, 160 and 162 with a controlled ribbon drive.

Figure 18:
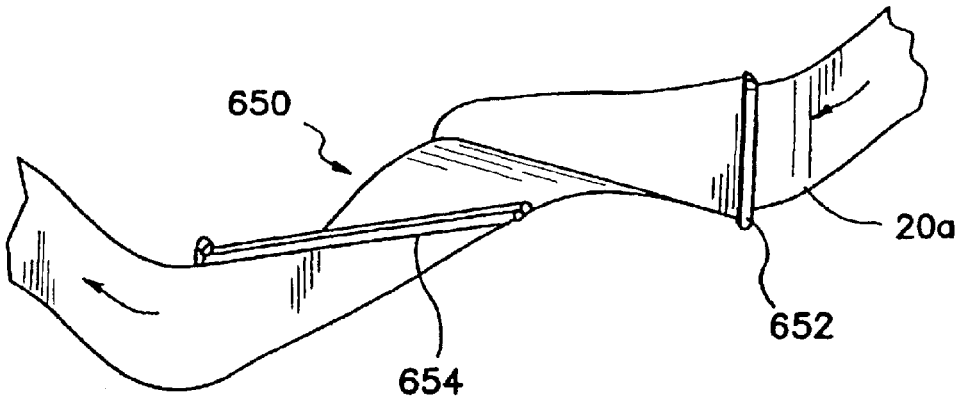
FIG. 18 is a perspective view of an ink ribbon employing a mobius loop for two sided ink transfer.

As a further improvement, shown in FIG. 18, the re-inking portion can provide for a mobius loop 650 that is turned by brackets or angularly turned guides or slots 652 and 654. These respective guides 652 and 654 allow the ribbon 20*a* to be turned in the direction shown for continuous travel in the direction of the arrows shown. In this manner, the mobius loop 650 provides for the ability of the ink ribbon 20*a* to pass twice and have both sides inked by making a double pass across the rollers 160 and 156 at different portions thereof.

In the alternative, a dual set of rollers can be utilized in the form of pairs or sets of rollers 156, 160 and 162. In this manner, ink from reservoir roller 36 can be imparted to a pair of transfer rollers 156 rolling against respective pressure rollers 160 so that a double pass of the ribbon 20*a* can be made through the mobius loop. The respective rollers 156 and 160 as well as the de-inking roller 162 can be served by the same reservoir roller 36, in double increments of two rollers each for inking the ribbon 20*a* through the mobius loop concept. Also, a dual pair of reservoir rollers 36 can be utilized.

The reservoir roller 36 can be formed with the entire system to only re-ink one entire portion or other multiples of the ink ribbon 20 or 20*a*. In this manner, only one or other multiples of the disks 286, 288, and 290 would be used. A single pump could be utilized with a single disk 288 to ink the entire ribbon through the whole length of the roller 36. This pump would be controlled by the sensor sensing the ink across the entire width of the ribbon 20 in a closed loop control system.

In order to improve printing at varying ambient temperatures, this invention can incorporate a multi-viscosity ink. This printer ink is described in U.S. patent application Ser. No. 10/316,784, bearing a filing date of Dec. 11, 2002, entitled "Multi-viscosity Printer Ink" and naming Jeng-Dung Jou, Dennis R. White, and Gordon B. Barrus as inventors, and is commonly assigned to the assignee of this application, and incorporated by reference herein as Exhibit A.

When ink flow changes due to ambient temperatures, it can affect flow through the reservoir roller 36, and flow paths A, B, and C as well as across rollers 156, 160 and 162. This in turn affects the proper amount of ink on the ribbon 20 and with its interstices.

Viscosity for an ink such as used with impact printers is a measure of the ink's thickness. Low viscosity printer ink loses shear strength at high temperatures even when disposed on a carrier such as the printer ink ribbon 20. This can result in ink smearing and ink migration. This lowers the print quality.

On the other hand, the viscosity of an ink that performs well at elevated temperatures becomes excessively high as to its viscosity at lower temperatures. Excessively high ink viscosity exhibits other printing problems. The problems can include poor transfer into and out of the printer ribbon 20, resistance to pumping through the small tubing, and a very slow transfer through the foam materials of the reservoir roller 36 as well as transfer from rollers 156, 160 and 162. Such foam materials used in the ink reservoir roller 36 to replace ink within the printer ribbon can clog the roller.

The printer ink should flow easily when the ambient temperature is cold through path A, B & C. The ideal ink should also remain thick enough so that it will not excessively migrate when the temperature is hot. Low ambient temperatures require a light (i.e. low viscosity) ink and high temperature requires a heavy (i.e. high viscosity) ink.

This invention can utilize a mixture of two or more inks of different viscosities to form multi-viscosity inks wherein the high molecule-weight spread (i.e. high poly-dispersity) performs well at a full temperature range in which print systems such as impact printers are expected to operate. These multi-viscosity inks remain sufficiently viscous at elevated temperatures, while maintaining a lower-than-normal viscosity at lower temperatures.

Figure 19:
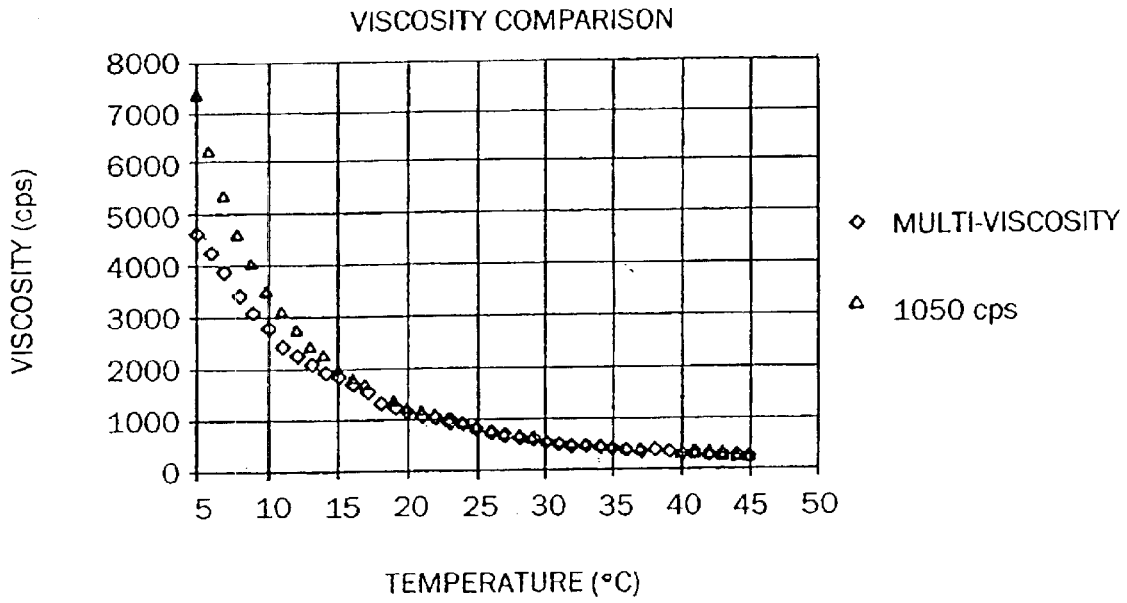
FIG. 19 is a plot of comparing the viscosity of a single viscosity ink to a multi-viscosity ink as a function of temperature, according to one embodiment.

Examples of multi-viscosity inks include a mixture of 50% by volume of a high viscosity ink (e.g., 1600 cps at room temperature) and 50% by volume of a low viscosity ink (e.g., 750 cps at room temperature). FIG. 19 shows a viscosity comparison between a multi-viscosity ink and a single viscosity ink. As seen, the multi-viscosity ink can improve flow conditions at cold temperatures and maintain the same properties as single viscosity inks at room temperatures and higher. High viscosities may cause a large amount of ink to flow onto the print media, causing smudging and other adverse print qualities. In one embodiment, a desired viscosity is around 1000 cps at room temperature.

In other embodiments, the percentage of high and low viscosity inks can be changed. For example, a mixture of 30% high viscosity ink (e.g., 1600 cps) and 70% low viscosity ink (e.g., 750 cps). This combination flattens the slope of the curve 5% and the intercept declines 5% in a logarithmic scale in comparison with the 50/50 mixture. Further, the viscosities can also be changed, such as a mixture of a 1600 cps ink with a 550 cps ink. In one embodiment, a high viscosity ink has a cps between approximately 1100 and 1600, while a low viscosity ink has a cps between approximately 300 and 900 cps. As will be appreciated by those skilled in the art, changing the mixture percentage and/or the ink viscosities used in the mixture will yield different results and different temperatures and can be optimized for a particular operating environment. For example, printing in heated areas may necessitate a different multi-viscosity ink mixture than printing in normally cold temperatures. The present invention may also be suitable for multi-viscosity ink mixtures formed from three or more single viscosity inks in different concentrations and viscosities. Additional details of multi-viscosity inks may be found in commonly-owned U.S. patent application Ser. No. 10/316,784, filed Dec. 11, 2002, and incorporated by reference in its entirety.

In order to extend ribbon life, a single high viscosity ink may be used and/or a thicker print ribbon may be used according to other embodiments. High viscosity inks, e.g., at least 1000 cps throughout a normal temperature operating range of 10° to 50° C., extend ribbon life by lubricating the ribbon fibers, thereby reducing frictional forces that develop within the ribbon and abrasion against guiding surfaces in the ribbon path. Further, using a thick print ribbon, such as between 0.0045" and 0.0055" thick, can extend the ribbon life by reducing the impact forces of the hammer on the print media. Thicker ribbons absorb and cushion the underlying print media as the hammer strikes the ribbon. Because more material (from the ribbon) is between the hammer and print media, damage to the ribbon, such as when the hammer breaks through the ribbon, is minimized. Another way to extend ribbon life, with or without a thick ribbon, is to use an elastomeric platen, such as disclosed in commonly-owned U.S. Pat. No. 6,244,768, entitled "Resilient elastomeric line printer platen having outer layer of hard material", which is incorporated by reference in its entirety. It should be noted that all features described do not have to be used for a printer or printing method and that using only one or more of the novel features provides benefits over conventional printers and methods.

The above-described embodiments of the present invention are merely meant to be illustrative and not limiting. It will thus be obvious to those skilled in the art that various changes and modifications may be made without departing from this invention in its broader aspects. Therefore, the appended claims encompass all such changes and modifications as fall within the true spirit and scope of this invention.

What is claimed is:

1. An impact printer comprising:

a plurality of hammers having printing tips;

a print ribbon for printing by impacts from said printing tips;

an electrical drive for causing said hammers to drive said printing tips against said print ribbon;

a supply of ink, wherein said ink comprises a mixture of two or more inks each ink having a different viscosity at the same temperature;

a reservoir roller for supplying said ink to said print ribbon;

at least one pump connected to said ink supply for supplying ink to said roller;

a sensor for determining the amount of ink on said ink ribbon;

at least one channel within said reservoir roller connected for fluid flow from said pump; and a circuit for causing said pump to pump ink to said reservoir roller when said sensor senses an ink condition on said ribbon.

2. The impact printer of claim 1, wherein said temperature is approximately 25° C.

3. The impact printer of claim 1, wherein said print ribbon is at least approximately 0.0045" thick.

4. The impact printer of claim 1, further comprising an ink-out detection circuit coupled to said at least one pump for determining when said supply of ink is depleted by monitoring changes in current.

5. The impact printer of claim 4, wherein the ink-out detection circuit comprises:

an electromechanical device coupled to said at least one pump for actuating said pump;

a resistor coupled to the electromechanical device; and a processor coupled to said resistor for monitoring the current through said resistor.

6. The impact printer of claim 5, wherein the electromechanical device is a solenoid.

7. A line printer comprising:

a plurality of print hammers having printing tips mounted on a hammerbank;

a permanent magnet for retaining said hammers;

a coil in associated relationship with each hammer for overcoming the permanent magnetic retention;

a print ribbon which traverses across said printing tips between two spools and is impacted by the printing tips to provide printing on a print media;

a porous reservoir roller having two or more segments which can receive ink in different quantities;

two or more channels within said reservoir roller, each connected to a respective segment of said reservoir roller;

an ink transfer roller for transferring ink to said print ribbon from said reservoir roller;

a sensor having two or more respective sensing portions for determining an amount of ink on said ribbon at two or more respective segments of said ribbon;

one or more pumps for pumping ink to said channels at a rate consistent with the ink requirements of a segment of said print ribbon;

a controller for causing said one or more pumps to pump ink in response to the amount of ink sensed by said sensor to a respective segment of said roller corresponding to a segment of said ribbon; and a circuit coupled to at least one of said one or more pumps for determining, by monitoring changes in current, when a supply of said ink is depleted.

8. The line printer of claim 7, wherein the circuit comprises:

an electromechanical device coupled to said one or more pumps for driving said one or more pumps;

a resistor coupled to the electromechanical device; and a processor coupled to said resistor for monitoring the current through said resistor.

9. The line printer of claim 8, wherein said electromechanical device is a solenoid.

10. The line printer of claim 9, wherein said one or more pumps has a diaphragm that is driven by said solenoid and actuated by an electrical pulse to said solenoid, and further comprising an inlet and outlet valve connected to a chamber overlying said diaphragm.

11. The line printer of claim 7, wherein said ink is a high viscosity ink having a viscosity of at least 1000 cps at 25° C.

12. The line printer of claim 7, wherein said ink comprises two or more single viscosity inks, each single viscosity ink having a different viscosity at a given temperature.

13. The line printer of claim 7, wherein said print ribbon is at least approximately 0.0045" thick.

14. A re-inker for a printer comprising:

an ink-retaining reservoir roller segmented into at least two segments for supplying multi-viscosity ink to two or more respective segments of an ink ribbon;

two or more channels interiorly of said reservoir roller for flowing ink to respective segments of said reservoir roller;

a pump coupled to each of said channels and an ink supply;

a sensor for sensing a quantity of ink on respective segments of said print ribbon; and an electrical drive for causing said pump to pump ink to a channel in response to said sensor for re-inking a segment of said ink ribbon.

15. The re-inker of claim 14, wherein said multi-viscosity ink comprises at least two single viscosity inks with different viscosities at the same temperature.

16. The re-inker of claim 15, wherein the temperature is approximately 25° C.

17. The re-inker of claim 14, wherein said ink ribbon is at least approximately 0.0045" thick.

18. The re-inker of claim 14, further comprising a circuit coupled to said pump for determining, by monitoring changes in current, when said ink supply is depleted.

19. A method of printing comprising:

providing a printer having a plurality of hammers having printing tips that impact a print ribbon;

feeding a media to be printed upon by impact of said printing tips against said print ribbon;

sensing the amount of ink on said print ribbon, wherein said ink comprises at least two distinct viscosity ink;

providing an ink-retaining reservoir roller;

providing a pump for pumping ink to said reservoir roller; and pumping ink to said reservoir roller in response to the amount of ink sensed on said print ribbon.

20. The method of claim 19, wherein said ink further comprises a low viscosity ink.

21. The method of claim 19, wherein said print ribbon is at least approximately 0.0045" thick.

22. The method of claim 19, further comprising sensing changes in current associated with said pumping, wherein said changes indicate an amount of ink remaining in an ink supply.

23. A method of re-inking a print ribbon comprising:

providing a source of ink, said ink comprising at least two distinct viscosity ink;

sensing the amount of ink on said print ribbon by light reflectance;

providing a porous reservoir roller which can receive ink within its interstices;

pumping ink from said ink source to said reservoir roller;

distributing ink pumped to said reservoir roller in response to the amount of ink sensed on said print ribbon to at least two distinct segments of said reservoir roller; and applying ink from said reservoir roller to at least two distinct segments of said print ribbon.

24. The method of claim 23, wherein said ink further comprises at least one low viscosity ink.

25. The method of claim 23, wherein said print ribbon is at least approximately 0.0045" thick.

26. The method of claim 23, further comprising sensing changes in current associated with said pumping, wherein said changes are used to indicate when said ink source is empty.

27. The method of claim 26, further comprising filling said ink source when said ink source is completely empty.

28. A method of re-inking a print ribbon comprising:

providing a source of ink, wherein said ink comprises a mixture of two or more inks each said ink having a different viscosity;

sensing the amount of ink on said print ribbon;

providing a reservoir roller having a porous portion which can receive ink within its interstices;

pumping ink from said ink source to said reservoir roller in response to the amount of ink sensed on said print ribbon;

distributing ink pumped to said reservoir to the porous portion of said reservoir roller; and providing ink from the porous portion of said reservoir roller to said print ribbon.

29. The method of claim 28, wherein said ink further comprises at least one ink of low viscosity.

30. The method of claim 28, wherein said print ribbon is at least approximately 0.0045" thick.

31. The method of claim 28, further comprising monitoring a current profile associated with said pumping, wherein said monitoring is used to determine when said ink source is depleted.

32. The method of claim 31, further comprising filling said ink source when said ink source is completed depleted.

* * * * *